US005579073A

United States Patent [19]

Ben-Yaacov

[11] Patent Number: 5,579,073

[45] Date of Patent: Nov. 26, 1996

[54] PHOTOGRAPHIC PROCESSING SYSTEM

[76] Inventor: Shlomo Ben-Yaacov, 51-C Lispenard St., New York, N.Y. 10013

[21] Appl. No.: 348,981

[22] Filed: Nov. 28, 1994

[51] Int. Cl.[6] ..... G03D 17/00

[52] U.S. Cl. ..... 396/598; 396/589; 396/651

[58] Field of Search ..... 354/331, 336, 354/325, 307, 327, 322, 324, 344, 308, 312, 309, 310; 355/27–29

[56] References Cited

U.S. PATENT DOCUMENTS

| | | | |
|---|---|---|---|
| 1,348,153 | 8/1920 | Core | 354/344 |
| 1,725,010 | 8/1929 | Menon | 354/308 |
| 2,909,979 | 10/1959 | Corrons | 354/308 |
| 3,208,335 | 9/1965 | Doherty | 354/308 |
| 3,524,396 | 8/1970 | Blinoff, Jr. | 354/312 |
| 3,703,860 | 11/1972 | Wilkinson | 354/312 |
| 3,884,149 | 5/1975 | Shores | 354/327 X |
| 4,185,912 | 1/1980 | Schwartz | 355/28 |
| 4,268,156 | 5/1981 | Kostiner | 354/324 |
| 4,575,209 | 3/1986 | Zwettler | 354/322 |
| 5,450,155 | 9/1995 | Carmen | 354/331 |

FOREIGN PATENT DOCUMENTS

| | | | |
|---|---|---|---|
| 127546 | 3/1932 | Australia | 354/331 |
| 2527560 | 1/1977 | Germany | G03D 13/00 |
| 3-116144 | 5/1991 | Japan | 354/322 |

OTHER PUBLICATIONS

Leedal Catalogue No. 79, Apr., 1989, pp. 2–24.
Omega/Arkay 1992 Catalog, pp. 19–32.

*Primary Examiner*—D. Rutledge
*Attorney, Agent, or Firm*—Howrey & Simon; C. Scott Talbot; Robert A. Auchter

[57] ABSTRACT

A compact integrated system for film and print processing has chemical processing trays, sink, water filter and faucet, chemical storage, and drying screens integrated into a single multi-purpose unit. The wheeled chemical processing trays are vertically stacked and rolled in horizontal corrugations traversing the length of the sink. A print under development is directly transferred vertically between chemical processing trays across a print sponge with a print gripper. Each print is uniformly processed in a chemical processing tray by rolling the tray, ensuring uniform distribution of the processing chemical without manually agitating the print. The water rinse step of the print development process is accomplished in an oscillating wash bath wherein the water is continuously circulated over and between the prints being rinsed. Each of the processing chemical trays may be angled downward for emptying into a basin which can also provide a sink as well as safe recycling/disposal following print processing. A hinged top cover provides a secure mounting for a water filter/faucet, a combination light table and safe light, and a scaled work surface when closed.

17 Claims, 24 Drawing Sheets

Fig- 13a
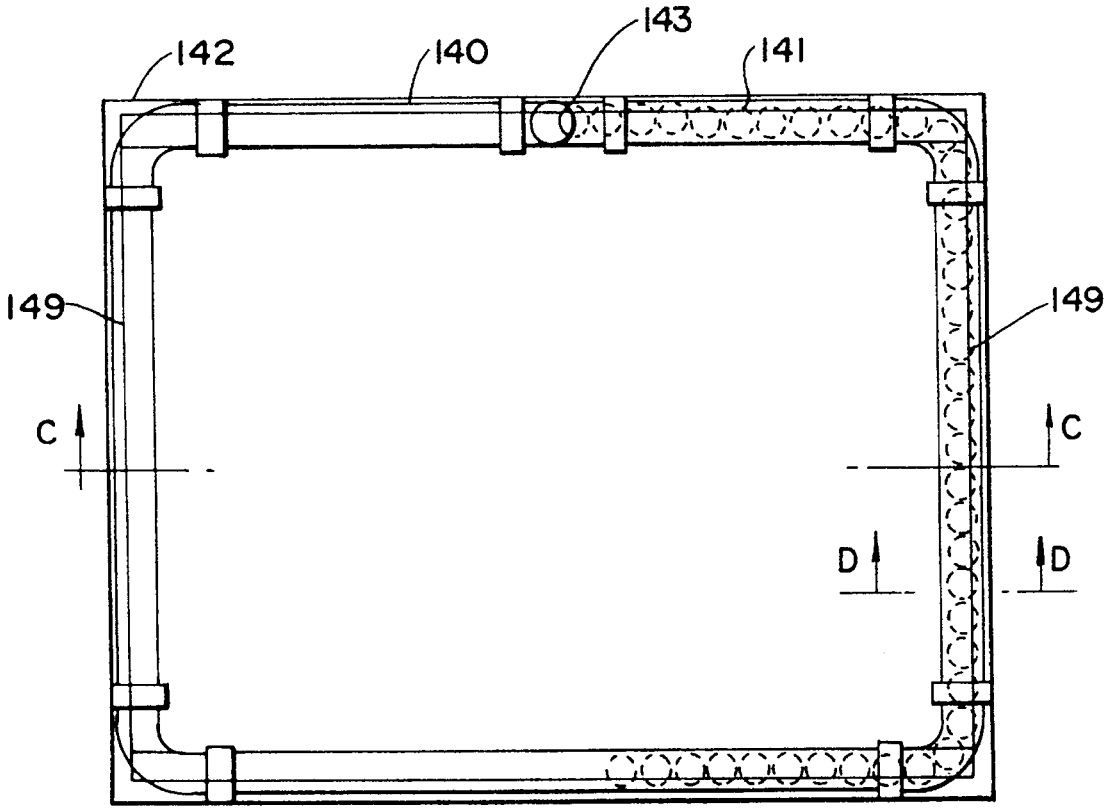
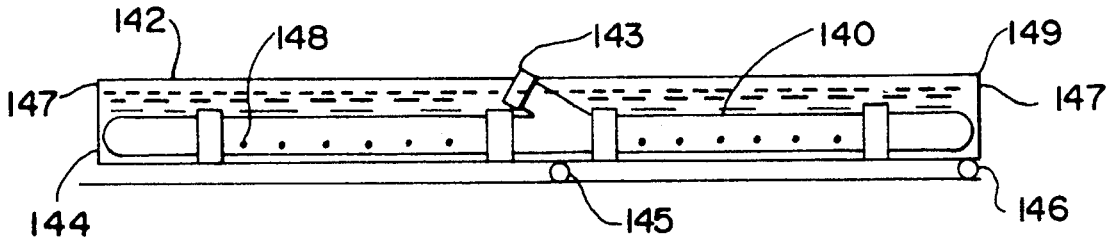
Fig- 13b

PHOTOGRAPHIC PROCESSING SYSTEM

BACKGROUND OF THE INVENTION

The present invention relates to photographic processing equipment, and specifically to an integrated system for complete photographic processing in a minimum space. The present invention incorporates the components of a standard darkroom, including a basin, water system, processing chemical trays, wash bath, light table, safety light, drying screens and storage areas into a single integrated unit.

A standard photographic print is produced by exposing a sheet of paper coated with photosensitive chemicals, typically silver halide, to light projected through an image. Once a photographic image is recorded on the silver halide crystals of a sheet of print paper, typically by illuminating the print with a "negative" image projected through an enlarger, the chemicals on the print are processed to develop and "fix" the image onto the paper by treating the print with processing chemicals. After the print has been processed with three separate chemicals (developer, stop bath and fixer) the print is washed in water to remove any excess chemicals remaining on the print and dried.

In conventional photographic print development, these processing chemicals are found in shallow trays arrayed horizontally on a flat surface, typically a smooth countertop in a darkroom. These trays are normally arranged linearly, adjacent to each other on the countertop. A print being developed is first placed into the tray filled with developer, then transferred from the developer to the stop bath to the fixer to the wash area by manually carrying the print to and between the trays with a pair of tongs. Because each print is processed by "agitating" the print in a tray, moving it back and forth while completely submerged in the processing chemical to ensure thorough and uniform coverage, each tray has to be filled to a relatively great depth. This has the undesirable effect of wasting processing chemicals and precipitating accidental spillage.

During processing, each print is normally held vertically over a tray before transfer to the next tray to allow any excess chemical absorbed by the print or adhering to the surface to drip off the print. However, this frequently cannot be done when oversized prints (e.g., 20"×24") are being developed because of the high probability of creasing the print while trying to raise it. In addition, for very large prints, it is simply not possible to raise the print high enough without assistance. These problems are particularly acute when archival prints are being developed because of the high porosity and absorptive properties of the fiber based paper used.

Another problem frequently encountered during traditional print processing in a photographic darkroom is that the prints tend to accumulate in a pile in the wash area where they are stacked directly on each other. This stacking prevents the water from adequately rinsing the chemicals off each print unless the water flows through the wash area under relatively high pressure. However, in addition to wasting water, high pressure water tends to fold and crease oversize prints without providing adequate rinsing and thus limits the number of oversize prints that can be efficiently developed.

Another problem encountered while processing oversized or archival prints is the tendency of these prints to fold or crease after the wash stage when the print is squeegeed. Using a conventional squeegee, it is extremely difficult to apply sufficient perpendicular compressive force while moving the squeegee in a straight line, and the squeegee is often skewed in the process, folding or creasing the print.

The traditional linear arrangement of development chemicals is particularly disadvantageous when developing oversized prints as the large trays needed to adequately cover the surface of each print can require a prohibitively large flat surface. If an adequately large surface is unavailable, a photographer may be forced to place the trays on the floor or somehow attempt to reuse a single large tray. Neither of these alternative procedures is regarded as satisfactory.

Another disadvantage of the traditional linear arrangement of print development chemicals is that when a photographer chooses to stop developing prints for a short period, oxidation and/or evaporation will quickly damage the chemicals unless the flow of air over the chemicals is reduced. Although this may be done by covering each of the individual trays used to develop standard size prints, it is impractical with the trays necessary for the development of oversized prints because of the large surface area which must be covered, ideally without any portion of the cover coming into contact with the chemical.

A photographer wishing to develop his or her own photographs has traditionally required a separate room that can be isolated from outside light and has a sink, a light table, a safe light, sufficient level countertop space to arrange the trays of development chemicals and wash bath, drying racks for the prints and storage space for the processing chemicals. These requirements cannot be met by an amateur photographer or a professional photographer without the resources for his or her own studio and darkroom. Furthermore, even a photographer with access to a typical darkroom with standard equipment is usually unable to develop prints larger than 11"×14" because of the processing problems inherent in their large size.

SUMMARY OF THE INVENTION

The present invention is an integrated darkroom facility for photographic processing that addresses the problems of inadequate space that frequently prevent photographers from developing their own prints or developing large prints without incurring prohibitive costs. By integrating all of the processing features of a typical darkroom (sink with a faucet, three chemical processing trays and a wash bath connected to a continuous water supply, a level work surface, a safety light, a light box, print drying racks, and storage areas for the chemicals) into a single unit incorporating a novel arrangement of print development processing chemicals in a vertical array of moveable processing trays, the drawbacks of the traditional linear arrangement of print development chemicals are overcome and photographers are able to process photographs in a fraction of the space previously required.

The photographic processing system disclosed herein occupies a minimum horizontal space while simultaneously enabling the development of oversized prints (using appropriate size trays) without requiring prohibitive amounts of countertop space or forcing the photographer to utilize unsatisfactory temporary arrangements (i.e., the floor). Each individual chemical processing tray is designed to be smoothly rolled back and forth, eliminating the need to manually agitate each print, and advantageously requires significantly reduced quantities of processing chemical in each tray. This novel arrangement of processing trays allows a photographer, while using trays that have the same length and width as standard print processing trays, to array the trays in a fraction of the horizontal space previously required. In addition to requiring less space, the present invention enhances the efficiency of photographic print development by providing an enhanced system for transporting prints to and between trays.

Three chemical processing trays (developer, stop bath and fixer) and an oscillating wash bath are vertically arrayed in the corrugated housing of the present invention. Each corrugation extends horizontally the length of the housing and provides a smooth and flat path along which each chemical processing tray can move. The ease with which the chemical processing trays are smoothly rolled back and forth, in conjunction with the wave guards integrated into each processing tray, enables each print to be processed by rolling the tray rather than manually agitating the print in a stationary processing tray. Because each stage of print processing is accomplished by moving the tray instead of moving the print, the quantity of processing chemical required is approximately half that typically required for a stationary tray. The oscillating wash bath disclosed herein ensures that every print is thoroughly rinsed by constantly recirculating water, eliminating problems of uneven rinsing and undesirable chemical deposits on the print. Relative to conventional print wash systems using stationary trays, significantly less water is required because of the continuous motion of water in the oscillating wash bath.

The present invention further enhances the development of oversized prints by facilitating the transfer of an oversized print between trays without creasing by use of the print gripper disclosed herein. The rolling print sponge of the present invention enables excess chemicals to be removed from the prints when moved from tray to tray instead of vertically hanging the print over the tray. Similarly, the rolling squeegee disclosed herein ensures uniform linear application of the squeegee to the print without creasing or folding the print.

The present invention, in addition to requiring less chemicals, also enhances the safety and efficient disposal and/or storage of chemicals used in the development process. The corrugated housing of the integrated photographic processing system of the present invention is safe and easily maintained because of the continuous smooth surfaces that provide smooth paths for the trays without protruding rails or other hazardous sharp edges. Each tray can be tilted without being removed from the housing, and any chemicals in the tray can then flow directly into an integrated basin for recycling or disposal. The present invention also provides for thorough and efficient removal of excess chemicals from prints under development, irrespective of their size, and thorough washing without risking creasing or folding of the print.

A two part hinged top cover, which also provides a light table, a safety light, a level working surface and water distribution, may be closed to cover the processing chemicals and reduce air circulation around the trays, thereby preserving the processing potency of the chemicals without individually covering each tray. In addition, the integrated structure also provides storage for drying screens, processing chemicals and adjustable shelving underneath the corrugated housing. The corrugated shelf-supports provide a user with the flexibility to configure and/or reconfigure the photographic processing system storage shelving as needed. The water basin of the photographic processing system may also be used as a standard sink for film development, pre-rinsing prints or preparing chemicals.

BRIEF DESCRIPTION OF THE DRAWINGS

FIG. 13*a* is a partially sectional top view of the oscillating wash bath.

FIG. 13*b* is a partially sectional side view of the oscillating wash bath take along line C—C of FIG. 13*a*.

DETAILED DESCRIPTION

Figure 1:
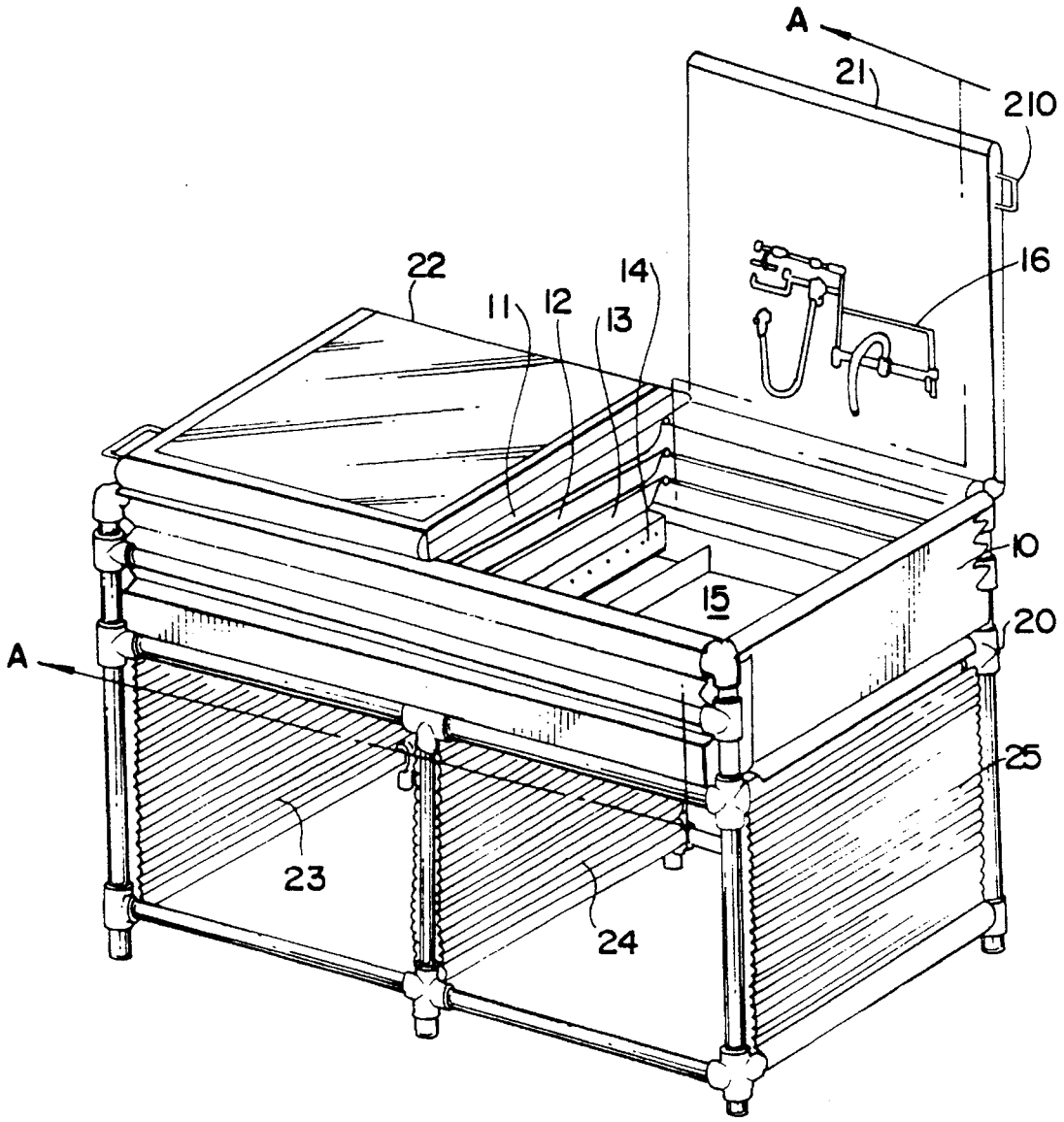
FIG. 1 is a perspective front view of the photographic processing apparatus of the present invention with the water filtration and faucet section of the top cover raised.

As illustrated in FIGS. 1–4 and 19, the photographic processing apparatus is a single integrated unit for photographic processing. The elements required for photographic processing that are normally arrayed throughout a darkroom are found on, in or underneath generally rectangular corrugated sink housing 10. As shown in FIG. 1, the chemical processing trays 11, 12 and 13, containing developer, stop bath and fixer, respectively, an oscillating print wash bath 14, and a sink basin area 15 are disposed within corrugated sink housing 10. Top cover 21, 22 is supported by and encloses corrugated sink housing 10. Water filtration and faucet system 16 is mounted on top cover 21 and a safe light and light box are incorporated into top cover 22. Tubular housing 20 both elevates and supports corrugated sink housing 10 and provides mounting for corrugated drying screen/shelf supports 23, 24 and 25 underneath corrugated sink housing 10. Print gripper 30, rolling print sponge 160 and rolling print squeegee 19 ensure that a print developed in the photographic processing system of the present invention is not creased or folded.

The dimensions of the photographic processing apparatus will vary in proportion to the size of the prints intended to be developed therein. In the preferred embodiment, the internal length of corrugated sink housing 10 is twice the length of each chemical processing tray 11, 12 and 13. The internal width of corrugated sink housing 10 at the apex of the outwardly protruding corrugations is preferably slightly greater than the length of the axle, including wheels, on each chemical processing tray. The flat bottom surface of each chemical processing tray is preferably slightly greater in both length and width to the corresponding dimensions of the print being developed. However, because significantly less processing chemicals are required for each tray, it is economical to process relatively smaller prints with larger trays.

Referring now to FIG. 1, chemical processing trays 11, 12 and 13 are shown in storage mode wherein the chemical processing trays are aligned vertically over oscillating wash bath 14 and basin area 15 is unobstructed. A two part top cover is preferably mounted to hinges affixed to the rear of corrugated sink housing 10 and provides a mounting surface for water filtration and faucet 16 on first cover 21, shown fully open. A rectangular handle 210 assists the user in raising and lowering the cover. The second cover 22 is shown in the closed position.

Figure 2:
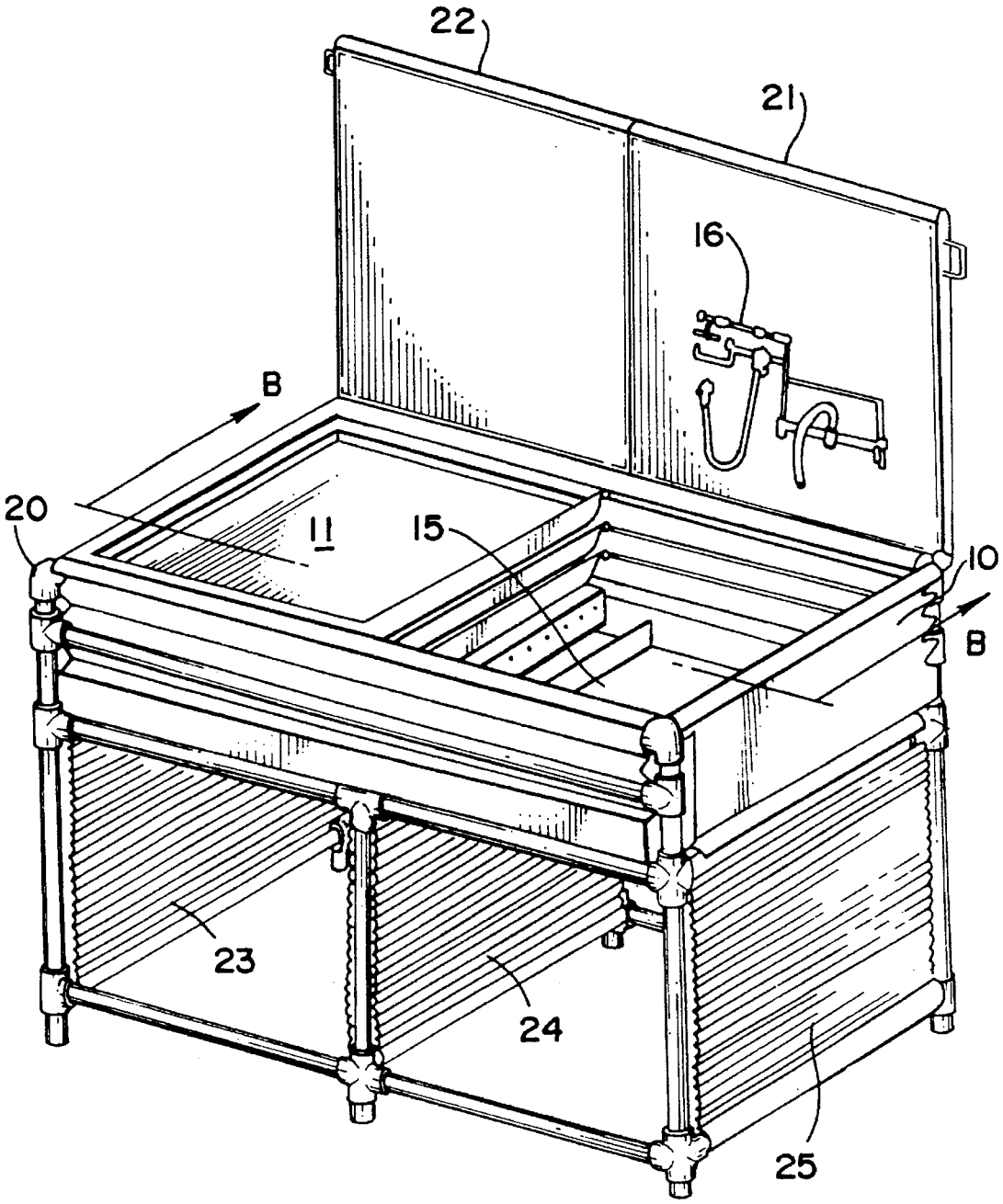
FIG. 2 is a perspective front view of the photographic processing apparatus of FIG. 1 with both sections of the top cover raised.

FIG. 2 shows the photographic processing system with first cover 21 and second cover 22 in the full open position. The bottom surface of second cover 22 is preferably constructed of a transparent or translucent material. A first fluorescent light fixture may be affixed inside second cover 22 to provide illumination, and if the first fluorescent light emits red light, this light acts as a safety light, providing illumination at a frequency that does not interfere with print processing.

Figure 3:
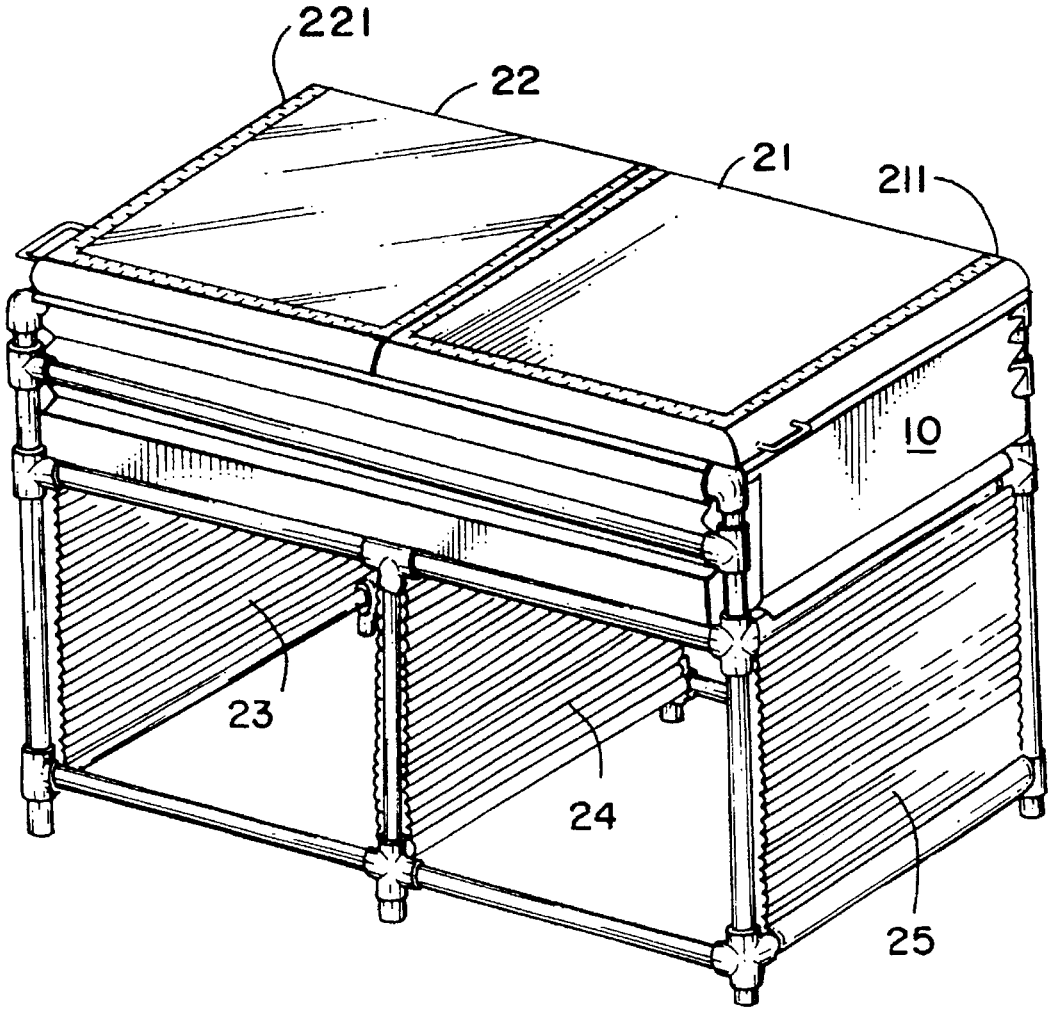
FIG. 3 is a perspective front view of the photographic processing apparatus of FIG. 1 with both sections of the top cover closed.
Figure 19:
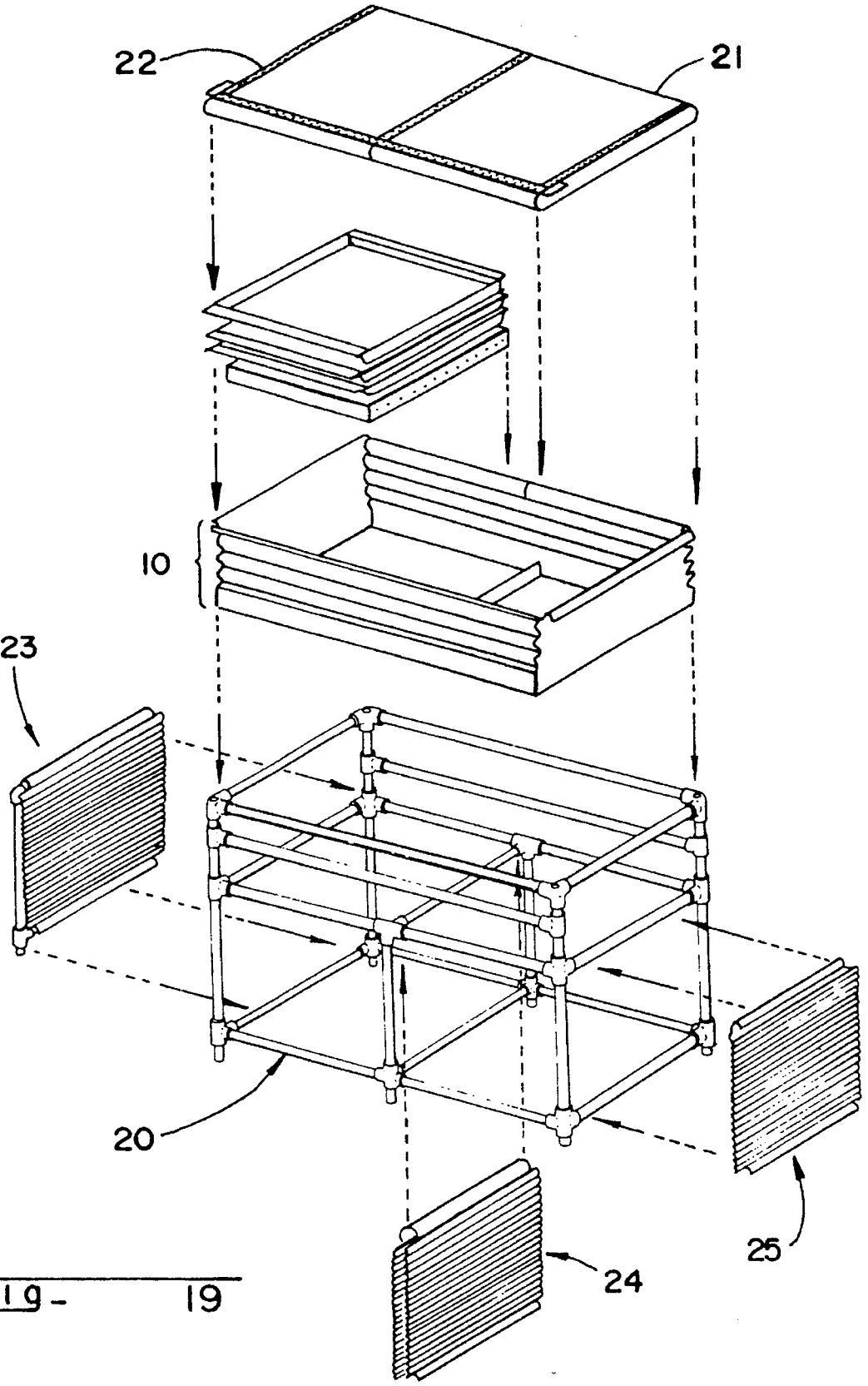
FIG. 19 is an exploded perspective view of the photographic processing apparatus of FIG. 1.

FIG. 3 shows the photographic processing system in standby mode with first cover 21 and second cover 22 in the closed position. Advantageously, an independently operated second fluorescent light fixture may be affixed inside second cover 22 where the top surface is constructed of a transparent or translucent material to provide a light box. In standby mode, the photographic processing system provides a level work surface which can be used as a drafting table or desk. Scale markings 211 and 221 provide guidance for print cropping and other common tasks, as does the separation between first cover 21 and second cover 22. FIG. 19 illustrates the separate elements of the photographic processing system in standby mode.

Figure 7:
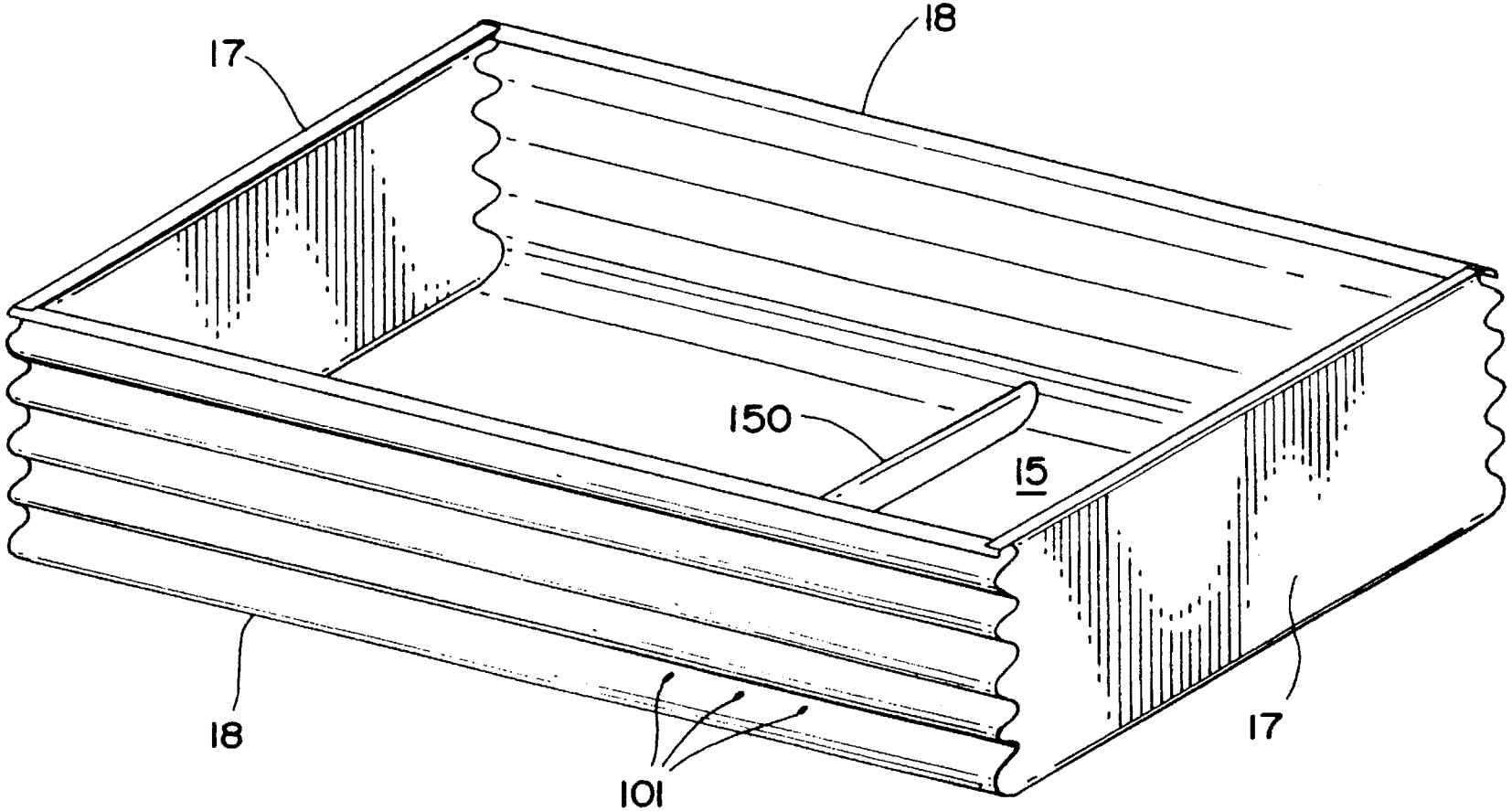
FIG. 7 is a perspective top view of the corrugated sink structure of the photographic processing apparatus of FIG. 1 without the processing trays.

Referring now to FIG. 7, corrugated sink housing 10 is illustrated without chemical processing trays 11, 12, and 13 or oscillating wash bath 14. As shown, first and second corrugated side walls 18 extend between first and second end walls 17. Corrugated walls 18 advantageously provide paths for movement of chemical processing trays 11, 12, and 13 inside corrugated sink housing 10 and first and second end walls 17 provide lateral support and ensure that corrugated sink housing 10 is completely enclosed. In the preferred embodiment, there are four horizontal corrugations in each corrugated side wall 18 with the corrugations mirroring the corrugation of the opposite side wall. Thus, the horizontal grooves formed by the corrugations create linear paths for tray movement. Corrugated sink housing 10 may be constructed of stainless steel, plastic, or any other water-resistant material with sufficient tensile strength to support the processing trays in the grooves formed by the corrugations without excessive deformation.

Apertures 101 in corrugated side wall 18 may provide access to basin area 15 for the disposal and/or recycling of chemicals from the chemical processing trays. A flexible hose (not shown) may be connected between each aperture and storage containers or an environmentally safe container for chemical disposal. Basin area 15 is segregated from the remainder of the bottom surface of corrugated sink housing 10 by vertical wall 150 extending completely between corrugated walls 18. Basin area 15 has an angled bottom surface 151 that directs any liquid retained in basin area 15 by basin area wall 150 toward the center of corrugated sink housing 10. If a level basin bottom is desired, an inversely angled perforated insert may be superimposed on angled bottom surface 151 of basin area 15.

Figure 9:
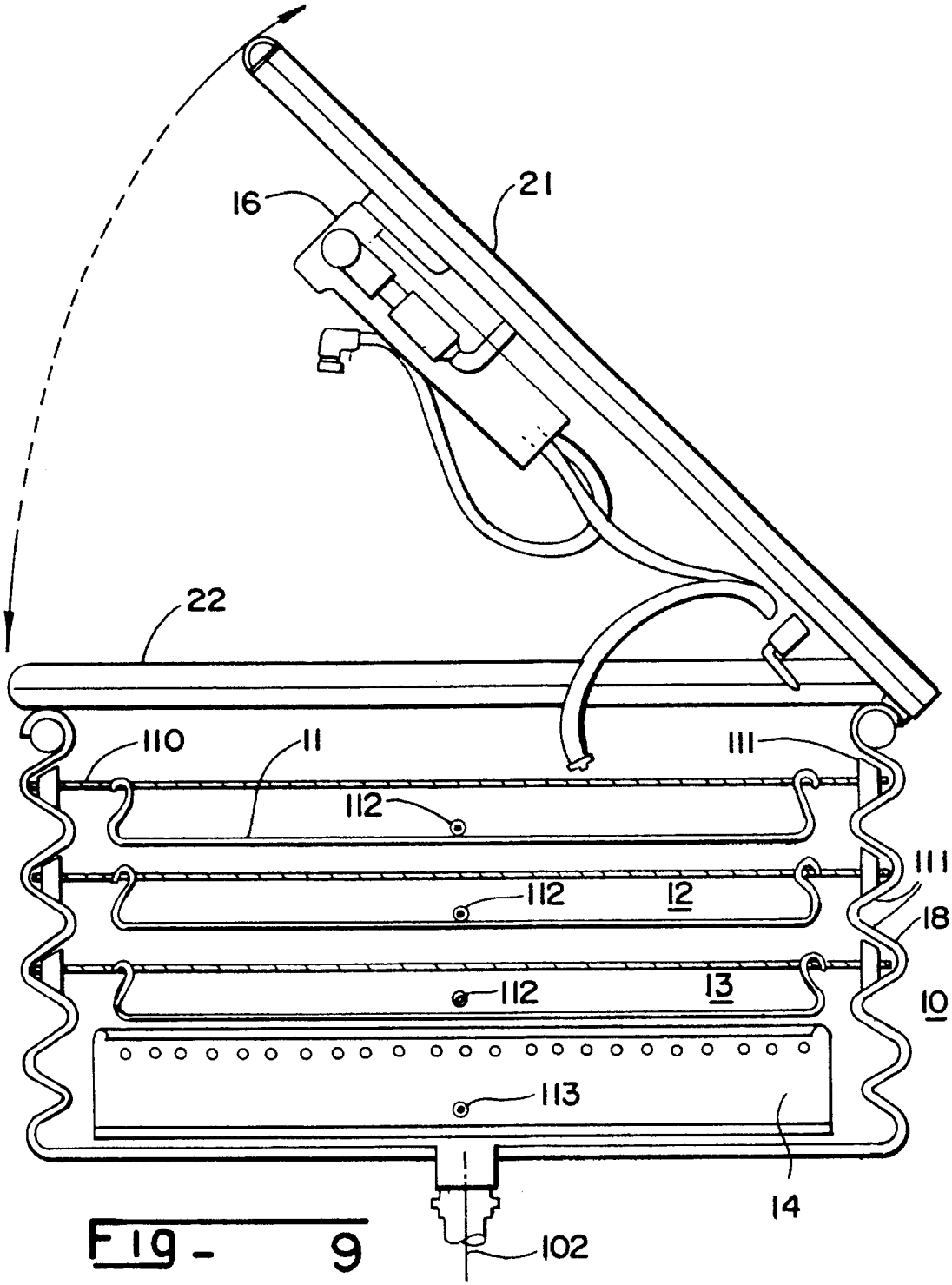
FIG. 9 is a partial cross-sectional side view of the photographic processing apparatus of FIG. 1 taken along line A—A illustrating the chemical processing trays and the conical wheels in the corrugated wheel tracks.
Figure 10:
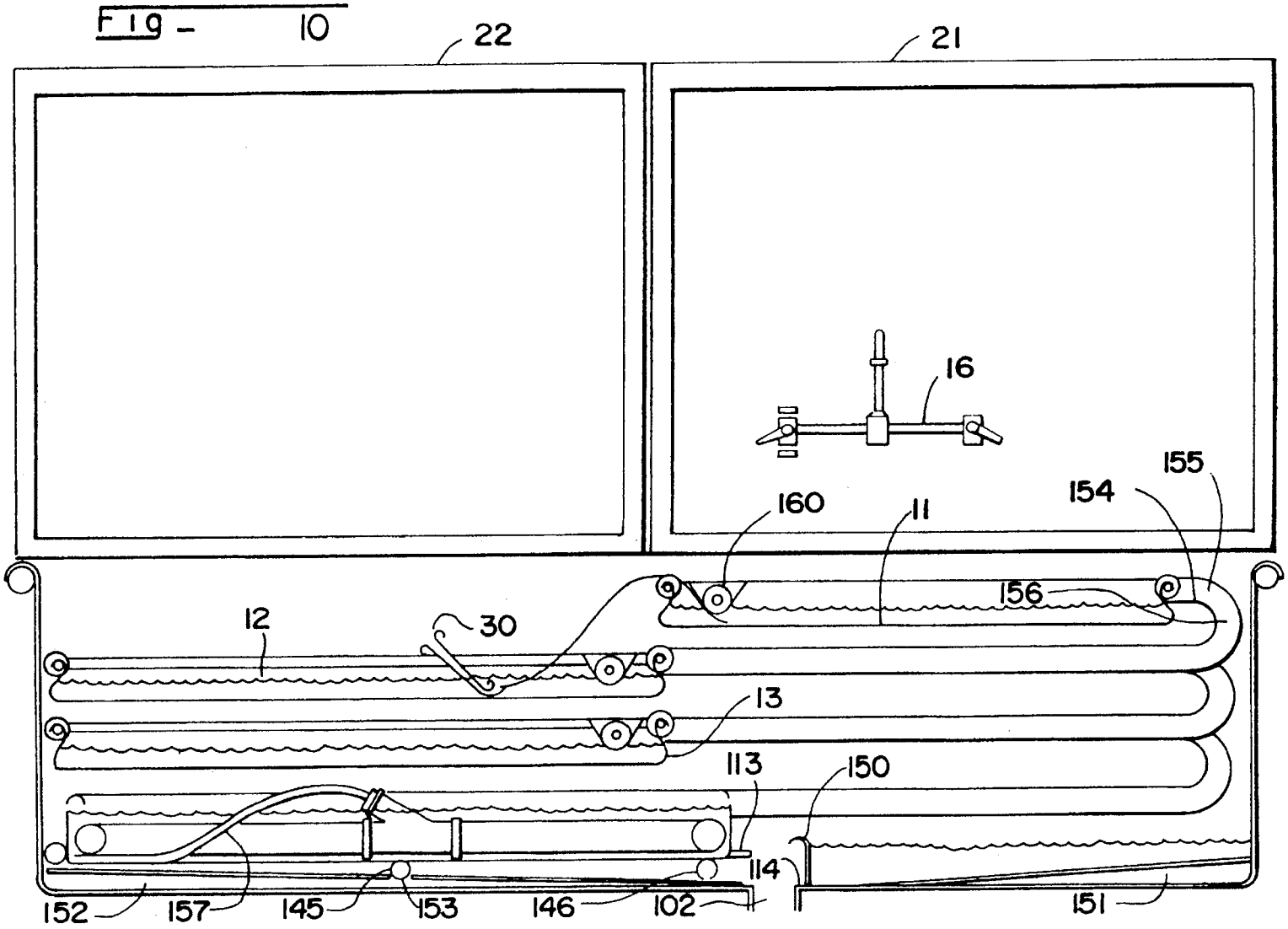
FIG. 10 is a partial cross-sectional front view of the photographic processing apparatus of FIG. 2 taken along line B—B illustrating the movement of a print from the developer bath tray to the stop bath tray.

Referring now to FIGS. 9 and 10, approximately central drain 102 provides a liquid drain outlet for corrugated sink housing 10. Fluids in basin area 15 may be emptied through central drain 102 when drain outlet 114 in vertical wall 150 is opened to provide a passage through basin area wall 150. Similarly, chemical processing trays 11, 12, and 13 each have a drain outlet 112 proximal to the bottom surface of each chemical processing tray. Drain outlet 112 may be advantageously opened to facilitate emptying the chemicals from each chemical processing tray. Oscillating wash bath 14 also has a protruding drain outlet 113 proximal to the bottom of oscillating wash bath 14 for drainage into central drain 102 when print processing is completed.

Chemical processing trays 11, 12 and 13 have substantially equivalent dimensions. For development of typical photographic prints up to 20"×24", the chemical processing trays 11, 12 and 13 have a width of 21" and a length of 25". Unlike conventional trays used in photographic processing, chemical processing trays 11, 12 and 13 have a depth of 2"–2½" as less processing chemicals are required for development when the print is not manually agitated. Chemical processing tray 11, closest to the top of the photographic processing system, contains developer, the first chemical in which the print under development is processed. Chemical processing tray 12, immediately below chemical processing tray 11, contains stop bath, the second chemical in which the print under development is processed. Chemical processing tray 13, immediately below chemical processing tray 12, contains fixer, the final chemical in which the print under development is processed before being washed in water in oscillating wash bath 14, located on the bottom interior surface of corrugated sink housing 10.

Referring now to FIG. 9, axles 110 are removably affixed to chemical processing trays 11, 12, and 13. Each axle 110 is fixedly mounted and does not rotate. Frustum-shaped wheels 111 are rotatably mounted to each end of axles 110 and frustum-shaped wheels 111 rotate freely about axles 110 when processing trays 11, 12 and 13 are moved in corrugated sink housing 10. Frustum-shaped wheels 111 are rubber with pressure fitted nylon bushings that rotate freely about a fixed axle. Each frustum-shaped wheel 111 travels in the horizontal groove formed by the corrugations of corrugated walls 18, thereby allowing each chemical processing tray to be rolled the length of corrugated sink housing 10. Chemical processing trays 11, 12 and 13 may be constructed of ABS, plastic, stainless steel or any material which is water-resistant, rigid and does not absorb chemicals.

Referring now to FIG. 10, oscillating wash bath 14 is generally rectangular and positioned on the bottom of corrugated sink housing 10. The bottom surface of corrugated sink housing 10 underneath oscillating wash bath 14 has a gradual incline 152, bisected by groove 153, sloping from side wall 17 toward central drain 102. Cylinders 144, 145 and 146 are fixedly mounted to oscillating wash bath 14. During normal operation, oscillating wash bath 14 oscillates so that cylinders 144 and 146 are alternately resting on incline 152. Cylinders 144 and 146 act as counterweights during the oscillation of oscillating wash bath 14 and preferentially have an equivalent mass. Cylinder 145, in cooperation with groove 153, acts as a fulcrum upon which oscillating wash bath 14 oscillates. Cylinders 144 and 146 may be metal pipes or constructed of any material with sufficient mass to counterbalance the oscillations of oscillating wash bath 14 under normal operation. Alternatively, cylinder 145 may be triangular or any shape upon which oscillating wash bath 14 can oscillate when cylinder 145 is placed in groove 153.

Oscillating wash bath 14 provides continuous circulation over the prints being washed with water supplied through flexible hose 157. Referring now to FIGS. 13*a* and 13*b*, oscillating wash bath 14 is encircled by rectangular wall 142, including perforated end walls 149. Cylindrical tube 140, adjacent to the interior surface of rectangular wall 142, similarly encircles oscillating wash bath 14. Rectangular wall 142 extends vertically beyond the diameter of cylindrical tube 140 and is arched inwardly at the top to restrict the flow of water out of oscillating wash bath 14 to perforations 147 in end walls 149. The water supplied through flexible hose 157 is received in Y-connector 143 and flows through cylindrical tube 140 which is perforated along its inside edge with a plurality of evenly spaced openings 148 through which water enters oscillating wash bath 14.

Figure 15:
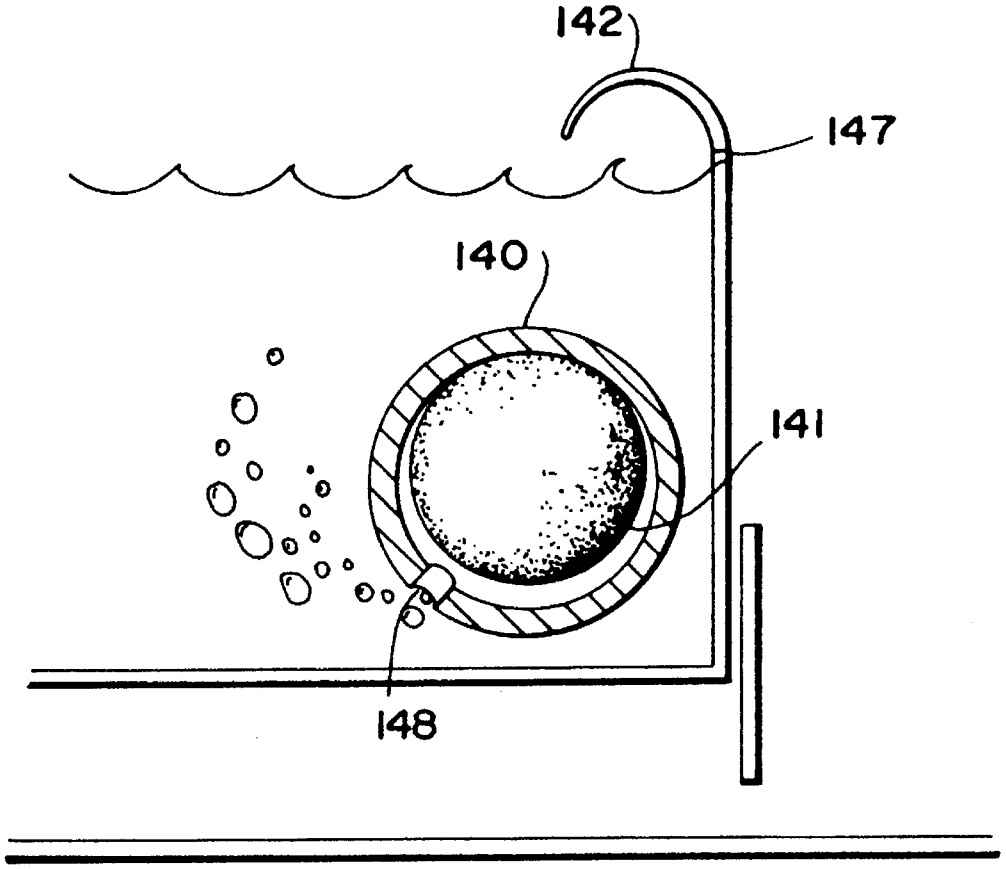
FIG. 15 is a partially sectional side view taken along line D—D of FIG. 13*a* illustrating the operation of the oscillating wash bath.

Half of the internal length of cylindrical tube 140 is filled by a plurality of flexibly interconnected light-weight spheres 141. The light-weight spheres, which may be float balls, ping pong balls or other hollow spheres, are preferentially interconnected with flexible strips of silicone and are propelled through cylindrical tube 140 by the water entering through Y-connector 143. FIG. 15 illustrates the relative dimensions and positioning of cylindrical tube 140, openings 148, lightweight spheres 141 and rectangular wall 142. Rectangular wall 142 is perforated by a plurality of openings 147 at end walls 149 of oscillating wash bath 14, thereby controlling the flow of water out of oscillating wash bath 14 during normal operation.

Figure 4:
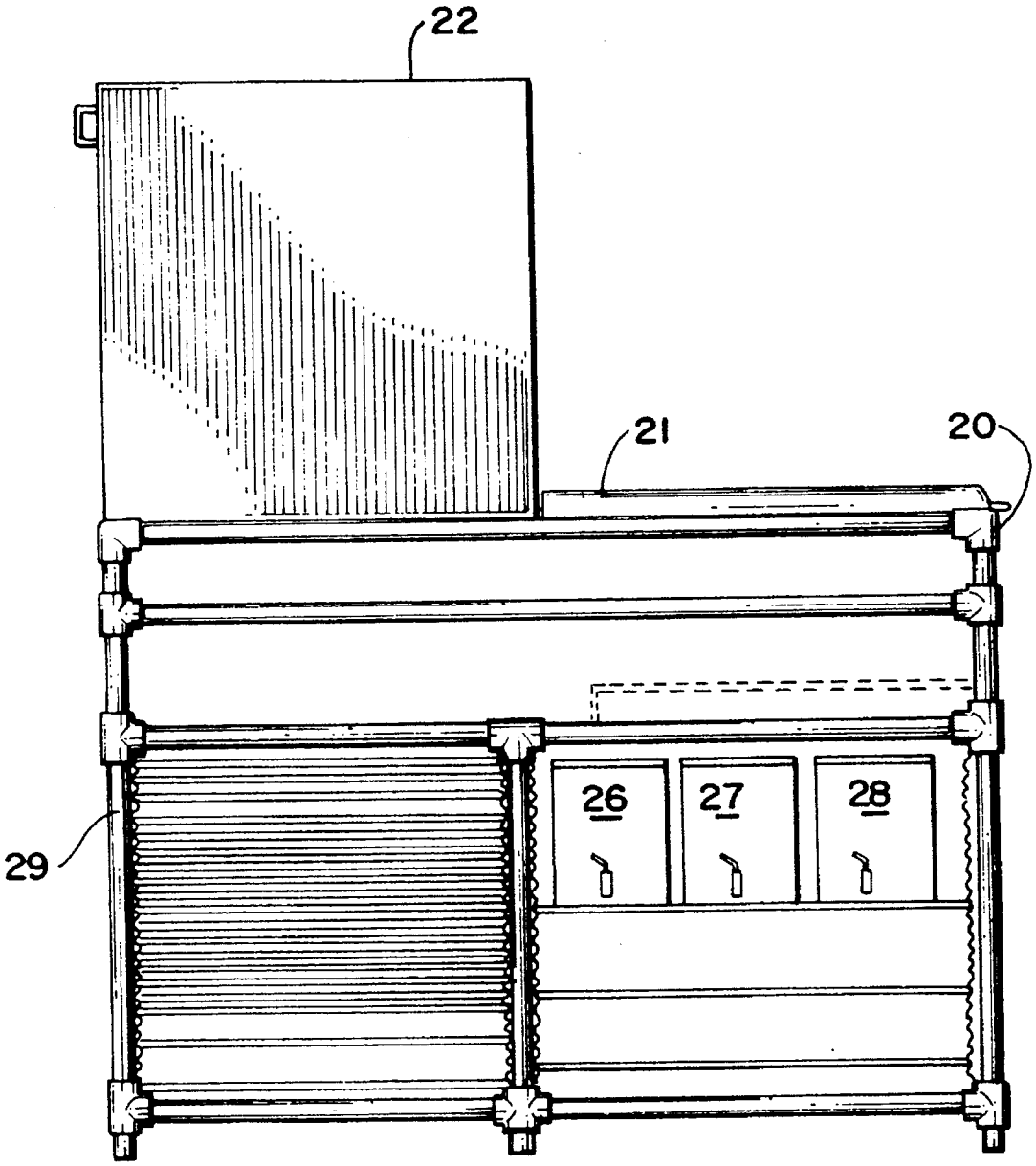
FIG. 4 is a front view of the photographic processing apparatus of FIG. 1 with both sections of the top cover closed showing the drying screens and chemical storage containers underneath the sink portion of the photographic processing apparatus.
Figure 5:
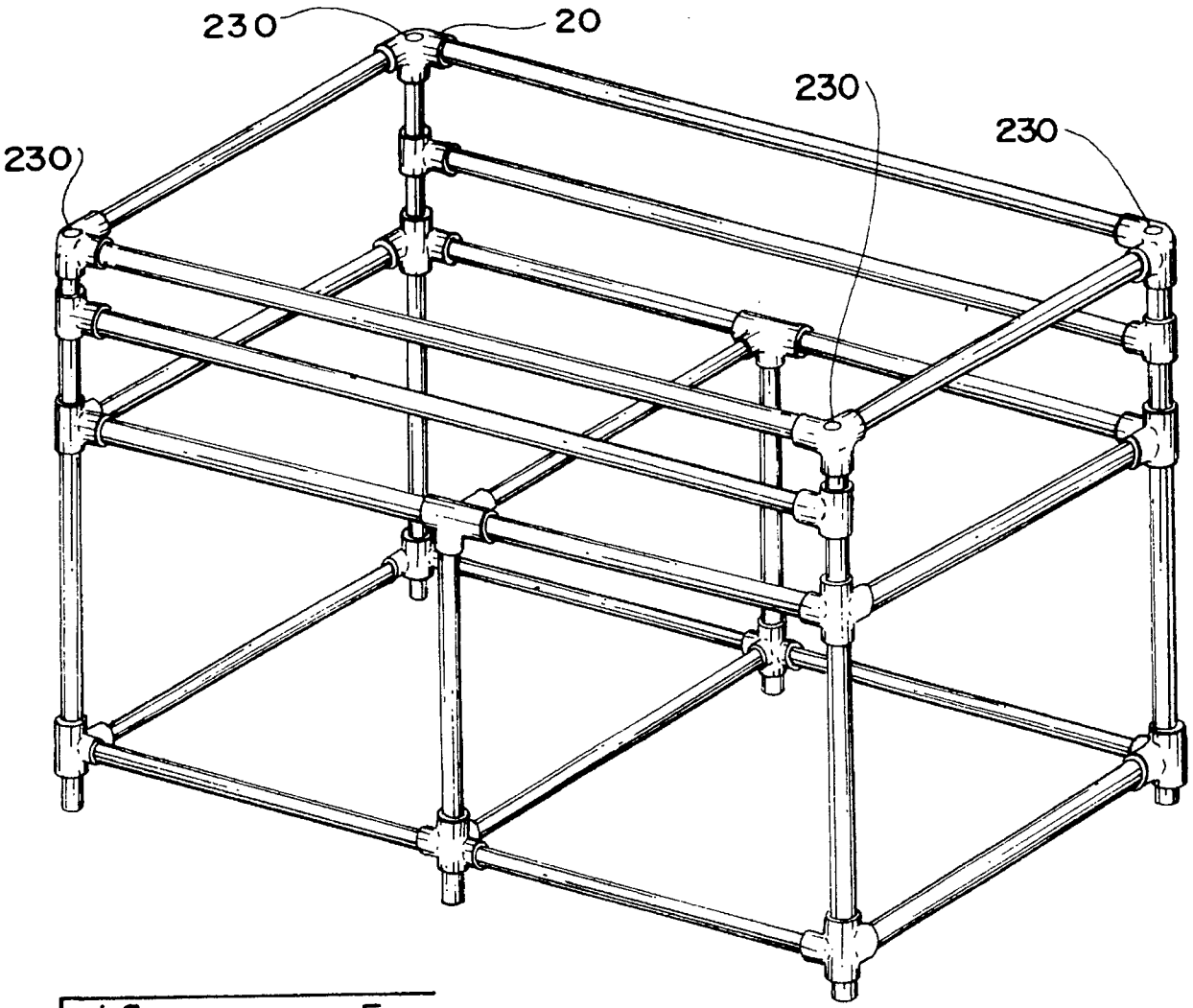
FIG. 5 is a perspective front view of the tubular structure that supports the photographic processing apparatus of FIG. 1.

As shown in FIG. 4, corrugated drying screen/shelf supports 23, 24 and 25 allow the space underneath sink 10 to be utilized for the storage of processing chemicals in containers 26, 27, and 28. In addition, prints may be placed on drying screens 29 advantageously stacked in the corrugations to ensure adequate ventilation between each drying screen. Referring now to FIG. 5, the tubular support structure 20 of the preferred embodiment is illustrated. Tubular support structure 20 may be constructed of PVC, stainless steel, copper or any rigid material fashioned into cylindrical tubes. Apertures 230 may be used to support a canopy arrangement (not shown) from which a light blocking curtain may be hung in a manner similar to a conventional shower curtain. In this embodiment, several photographic processing systems could provide individualized darkroom facilities in a classroom environment.

Figure 6:
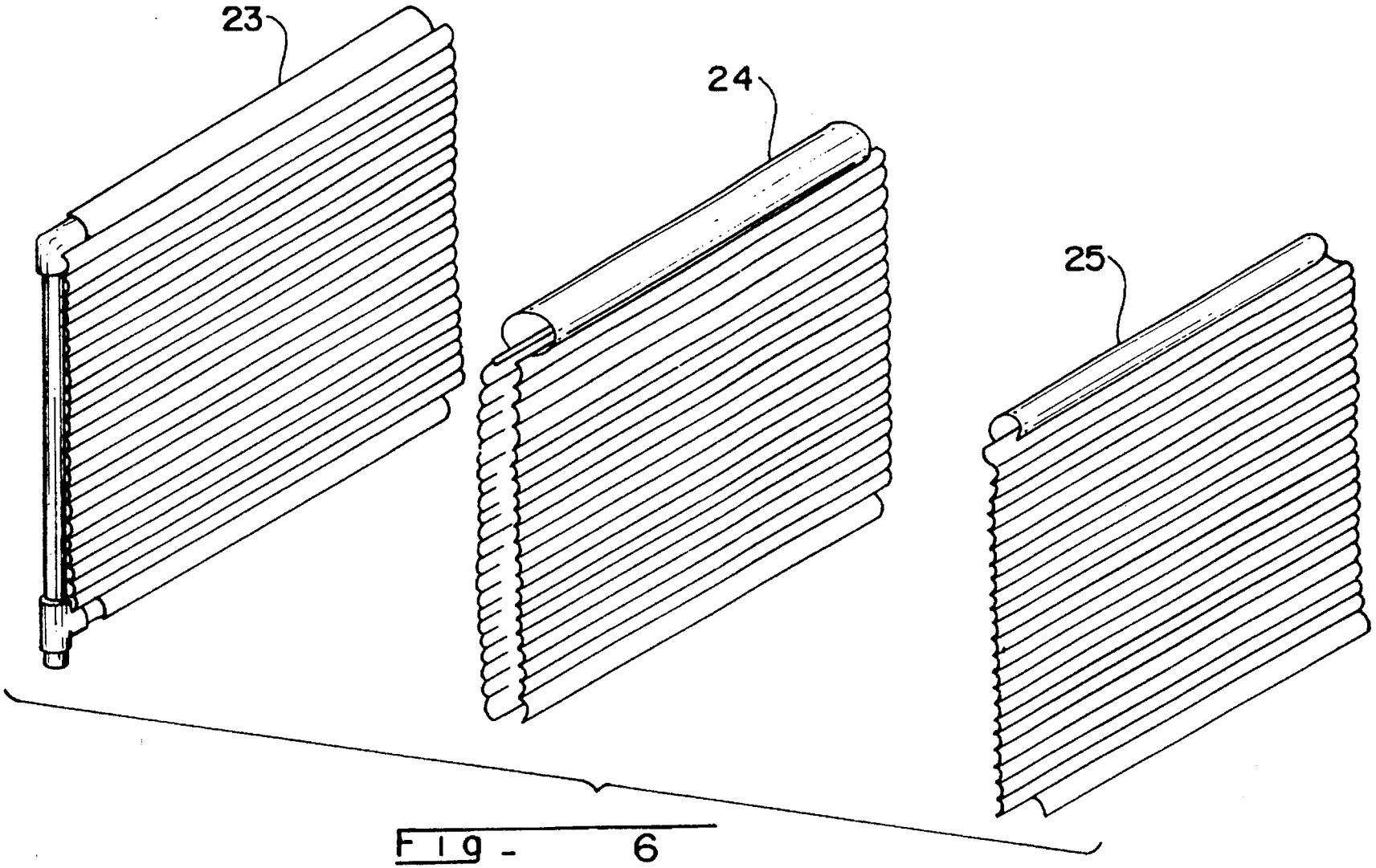
FIG. 6 is a perspective side view illustrating the corrugated shelf supports that are positioned on the outer sides and middle of the lower portion of the tubular structure of FIG. 5.
Figures 24A, 24B:
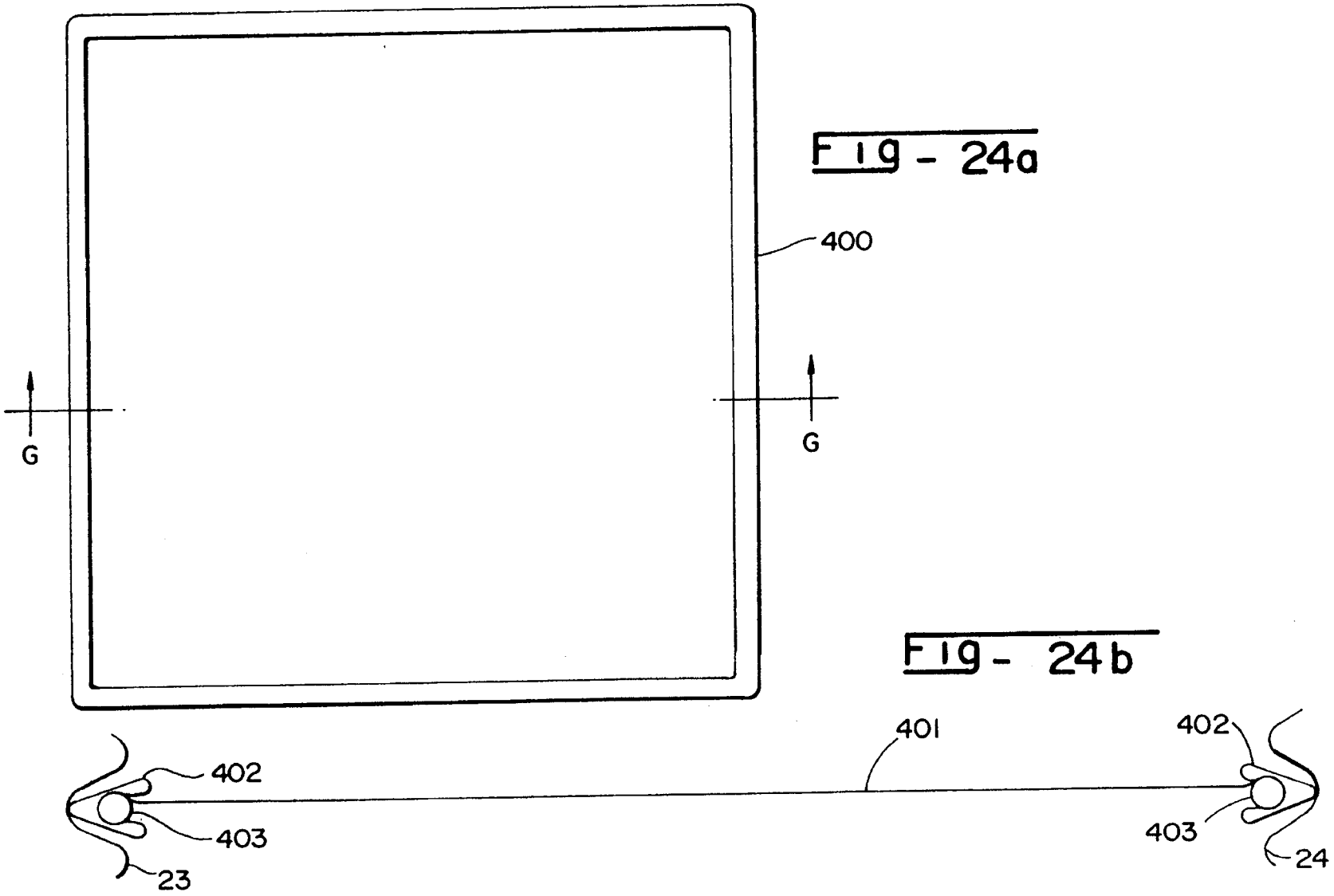
FIG. 24*a* is a top view of a print drying screen.
FIG. 24*b* is a cross-sectional side view of a print drying screen taken along line G—G of FIG. 24*a*.

Referring now to FIG. 6, corrugated drying screen/shelf supports 23 and 25 may be single-sided and central shelf-support 24 double-sided. Central shelf support 24 is advantageously constructed by combining corrugated shelf supports 23 and 25. Referring now to FIGS. 24*a–b*, print drying screens 29 have rounded frame edges 402 that obvious advantageously interfit with the grooves formed by the corrugations of the drying screen/shelf supports 23 and 24. A fiberglass screen 401 is stretched taut between rounded frame edges 402 and retained therein by rubber retainers 403.

Figure 18:
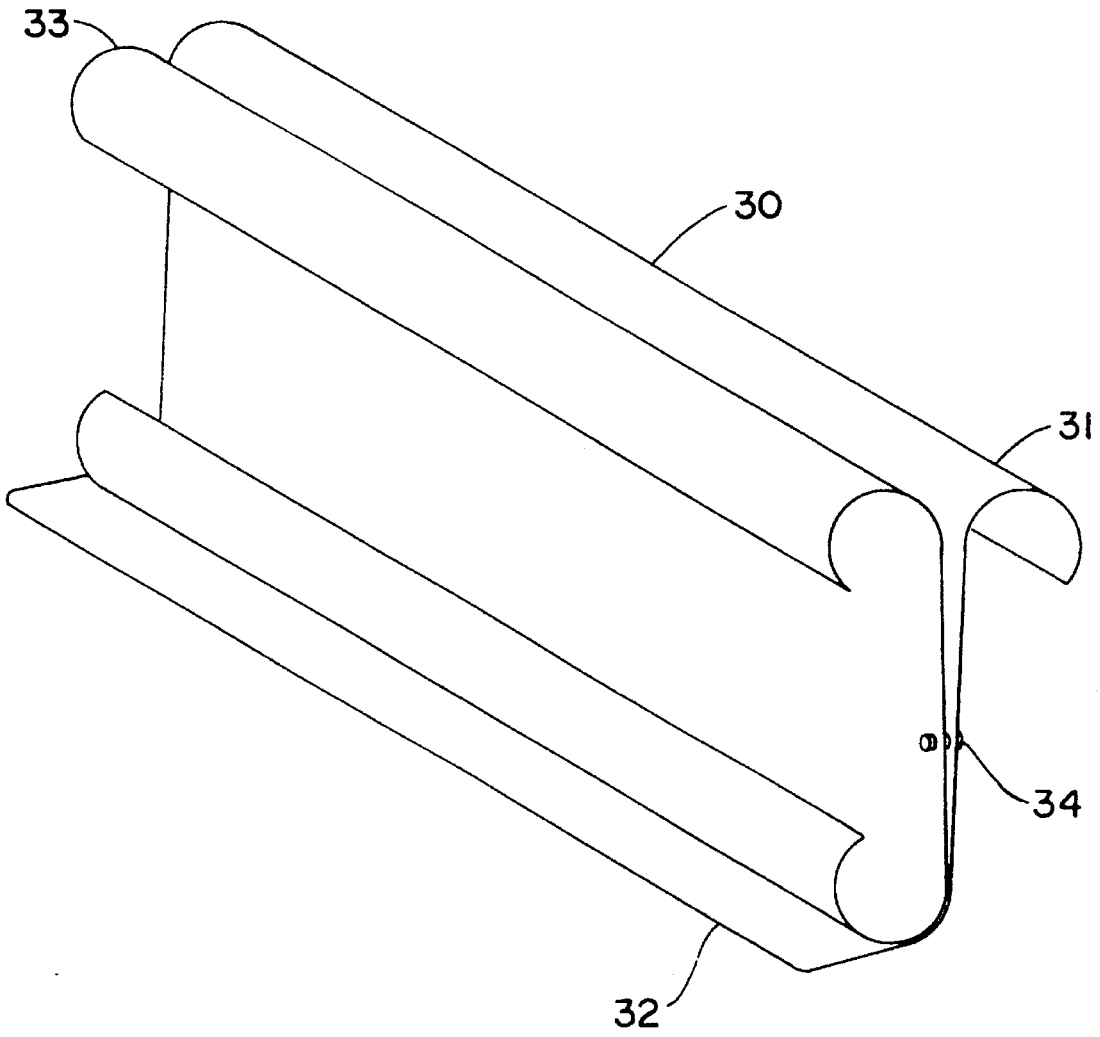
FIG. 18 is a perspective top view showing the print gripper used to transport prints.

Referring now to FIG. 18, print gripper 30 transfers the print without creasing or folding the print. Retaining clip 34 keeps the two gripping surfaces in contact while spring clip 31 compresses curvilinear surface 33 against planar surface 32. The width of print gripper 30 is advantageously equal to or slightly greater than the width of the print being developed, thereby eliminating the possibility of creasing or folding.

Figure 16B:
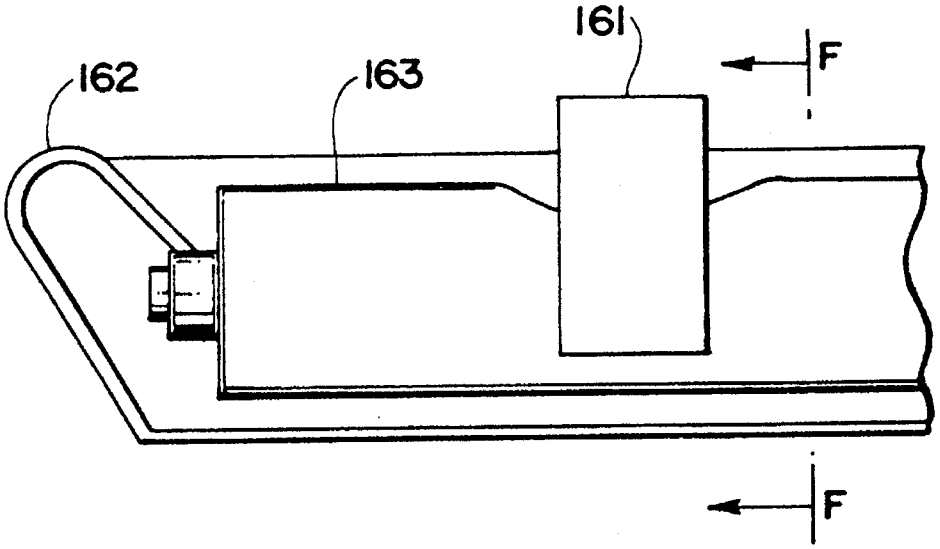
FIG. 16*b* is a partially sectional front view taken along line E—E of FIG. 16*a* illustrating the print sponge mounted to a processing tray.
Figure 16A:
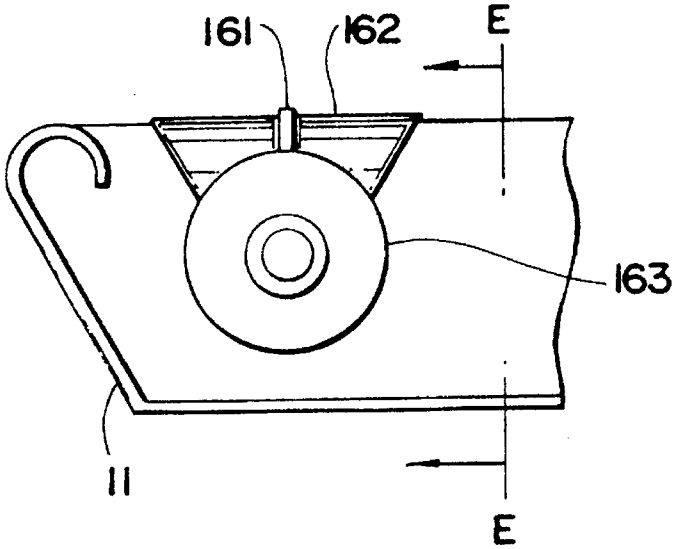
FIG. 16*a* is a partially sectional side view taken along line F—F of FIG. 16*b* illustrating the print sponge removably mounted to a processing tray.

Print sponge 160 removes any excess processing chemical from the print before it is placed into the next tray. Referring now to FIGS. 16*a* and 16*b*, print sponge 160 is cylindrical and equal in length to the width of chemical processing trays 11, 12 and 13. Cylindrical rubber sponge 163 is mounted around a cylindrical rod fixedly mounted to triangular brackets 162 which are removably mounted to the edges of chemical processing trays 11, 12 and 13. Print sponge 160 may be moved using nylon sponge ringer 161 which partially encircles rubber sponge 163 in a C-clamp. Because the diameter of the C-clamp is narrower than the diameter of rubber sponge 163, the area of rubber sponge 163 under sponge ringer 161 is compressed and fluids absorbed by the sponge are ejected. Sponge ringer 161 may be slid along the length of print sponge 160 to remove chemicals absorbed by rubber sponge 163 whenever necessary.

Figure 17:
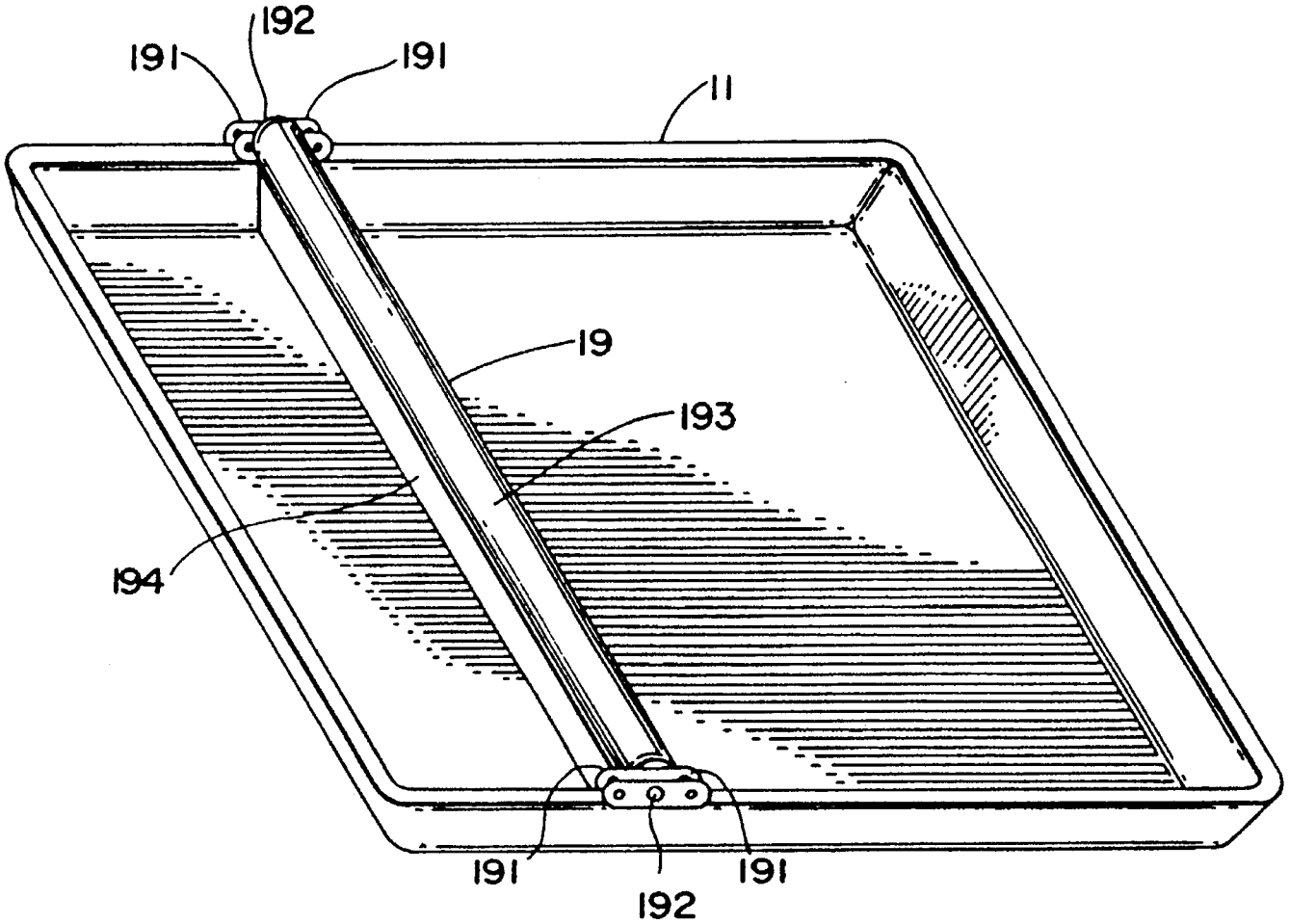
FIG. 17 is a perspective top view showing the rolling print squeegee on a processing tray.

Referring now to FIG. 17, rolling print squeegee 19 may be utilized to squeegee water off of the prints. Cylinder 193 extends the width of processing tray 11 and is bounded on either end by wheel carriers 192. Two concave wheels 191 held in each wheel carrier 192 are in rotating contact with the top of the wall of chemical processing tray 11 when print squeegee 19 is moved along chemical processing tray 11. The dual wheel embodiment of the wheel carriers advantageously ensures that rolling print squeegee 19 remains straight while the print is being squeegeed. Triangular rubber squeegee 194 fixedly mounted to cylinder 193 is extends the height of the walls of chemical processing tray 11 and therefore applies pressure to prints in chemical processing tray 11 to remove any excess water.

Figure 8:
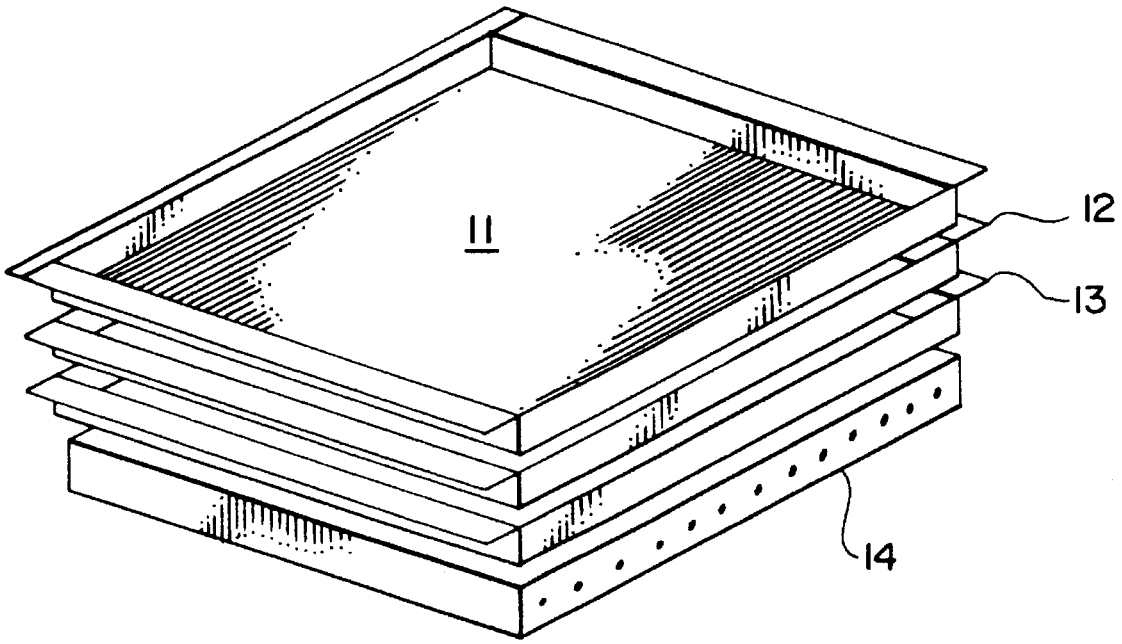
FIG. 8 is a perspective top view of the photographic processing apparatus of FIG. 1 showing the vertical arrangement of the processing trays.

The process by which a print is developed using the photographic processing apparatus is illustrated in FIG. 10. Basin area 15 may be filled with water from water filtration and faucet 16 and used to pre-rinse the prints before processing. Referring now to FIG. 8, chemical processing trays 11, 12 and 13 and oscillating wash bath 14 are shown in storage mode, with chemical processing trays 11, 12 and 13 in a stack over oscillating water bath 14. By placing chemical processing trays 11, 12 and 13 in storage mode, access to basin area 15 is completely unobstructed, allowing basin area 15 to be used as a deep sink to prepare chemicals, process film or other such tasks.

Figure 20A:
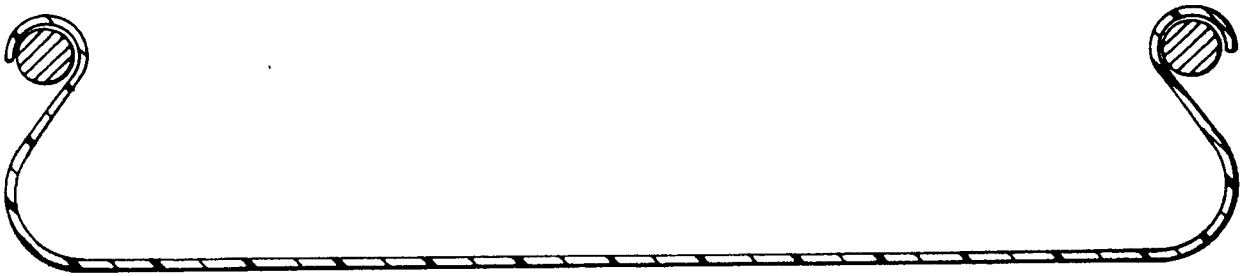
FIGS. 20*a–c* are cross-sectional side views illustrating alternative implementations of the wave guard feature of the processing trays of the photographic processing apparatus.
Figure 20B:
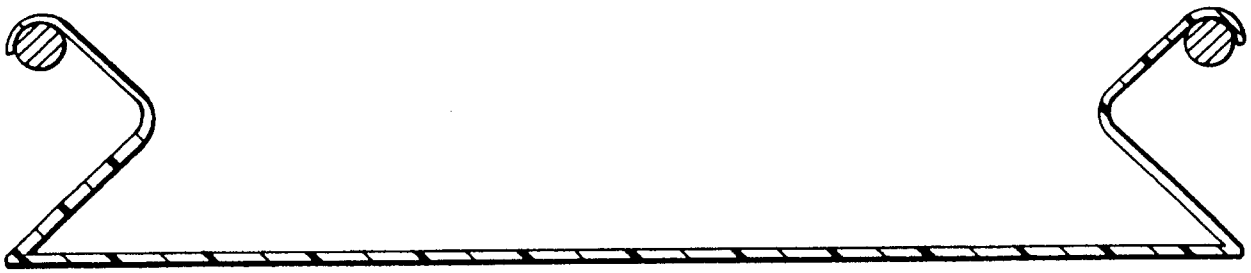
Figure 20C:
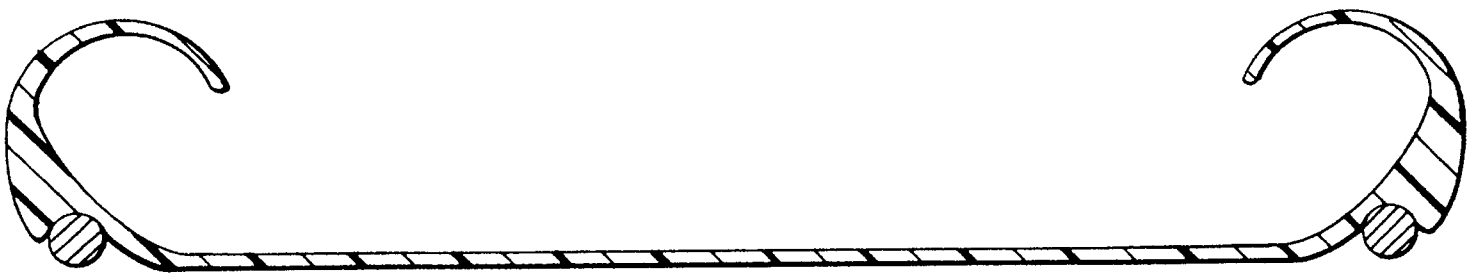

After pre-rinse in basin area 15, the print under development is then placed into the developer in chemical processing tray 11. Advantageously, the print may be moved without creasing or folding using print gripper 30. While the print is immersed in the developer in chemical processing tray 11, the chemical processing tray is rolled back and forth to ensure continuous even distribution of the developer over the entire print. By rolling the tray instead of manually agitating the print, significantly less processing chemicals are required to ensure adequate processing in each tray and the depth of each tray may be significantly less than conventionally required. The processing chemicals are prevented from inadvertently splashing out of the chemical processing tray by a wave guard integrated into the end walls of each chemical processing tray as illustrated in FIG. 20*a*. Referring now to FIG. 20*a*, the end walls of the chemical processing trays are angled inward to inhibit any waves generated by the rolling motion. Alternative embodiments of the wave guard are illustrated in FIGS. 20*b–c*.

Referring again to FIG. 10, once the image is sufficiently developed, chemical processing tray 11 is rolled to the opposite side of corrugated sink housing 10. Excess chemicals are removed from the print under development when it is advantageously moved under and across print sponge 160. Once a print under development has been completely immersed in the stop bath in chemical processing tray 12 the print is then transferred to the fixer in chemical processing tray 13. This is advantageously accomplished by gripping the print with print gripper 30 and rolling chemical processing tray 12 while holding the print under development stationary. As chemical processing tray 12 is moved, any excess stop bath is sponged off the print by print sponge 160 and the print is gradually immersed in the fixer in chemical processing tray 13 below. This procedure may be repeated when transferring the print under development from chemical processing tray 13 to oscillating wash bath 14. The print is left to be washed by the continuously circulating water, chemical processing trays 11, 12, and 13 are returned to the storage mode position and another print can be developed.

Figure 14A:
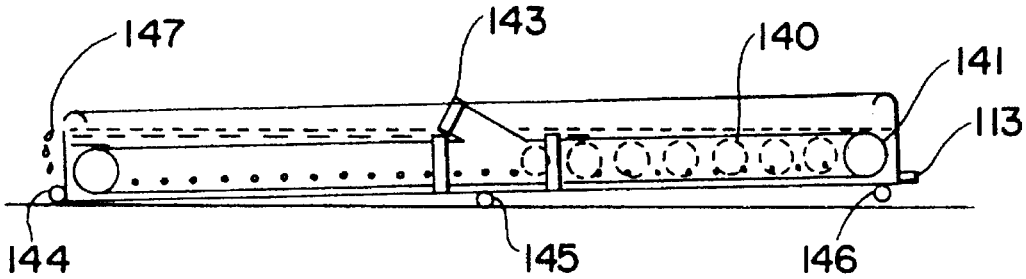
FIGS. 14*a–c* are partially sectional side views taken along line C—C of FIG. 13*a* illustrating the operation of the oscillating wash bath.
Figure 14B:
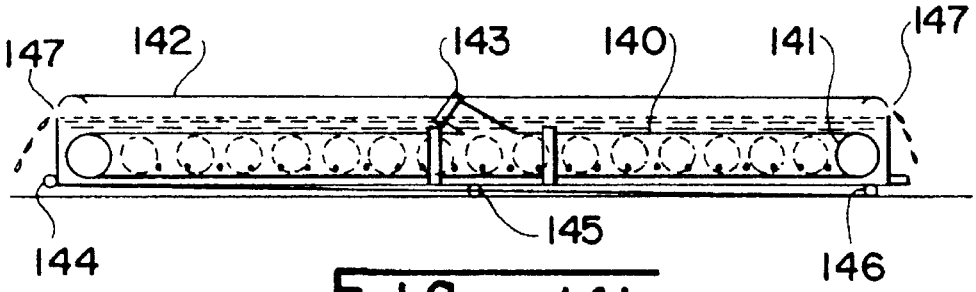
Figure 14C:
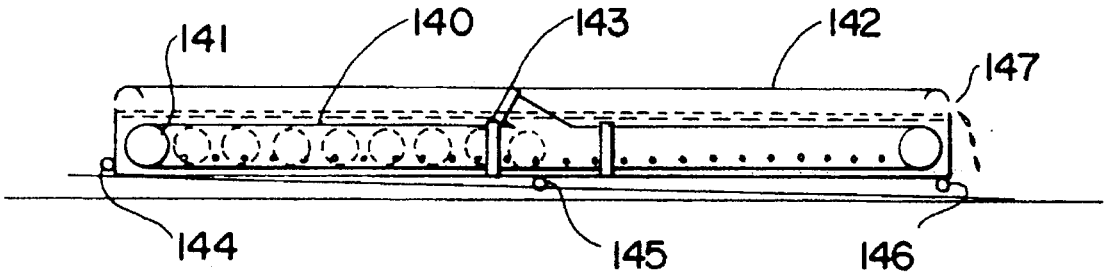

Referring now to FIGS. 14*a–c*, the operation of oscillating wash bath 14 is illustrated. In FIG. 14*a*, lightweight spheres 141 occupy the entire right half of cylindrical tube 140 and water completely fills the remaining half. Because of the greater weight of the water in the other half of cylindrical tube 140, oscillating wash bath 14 is tilted on fulcrum 145 to the left, creating a wave in the water that has filled oscillating wash bath 14 through openings 148. In FIG. 14*b*, lightweight spheres 141 are equally distributed between the right and left halves of oscillating wash bath 14 which is in a state of temporary equilibrium. In FIG. 14*c*, the lightweight spheres 141 occupy the entire left half of cylindrical tube 140 and water completely fills the remaining half. Because of the greater weight of the water in the right half of cylindrical tube 140, oscillating wash bath 14 is tilted on fulcrum 145 to the right, creating another wave in the water filling oscillating wash bath 14, although in the opposite direction.

Figure 12:
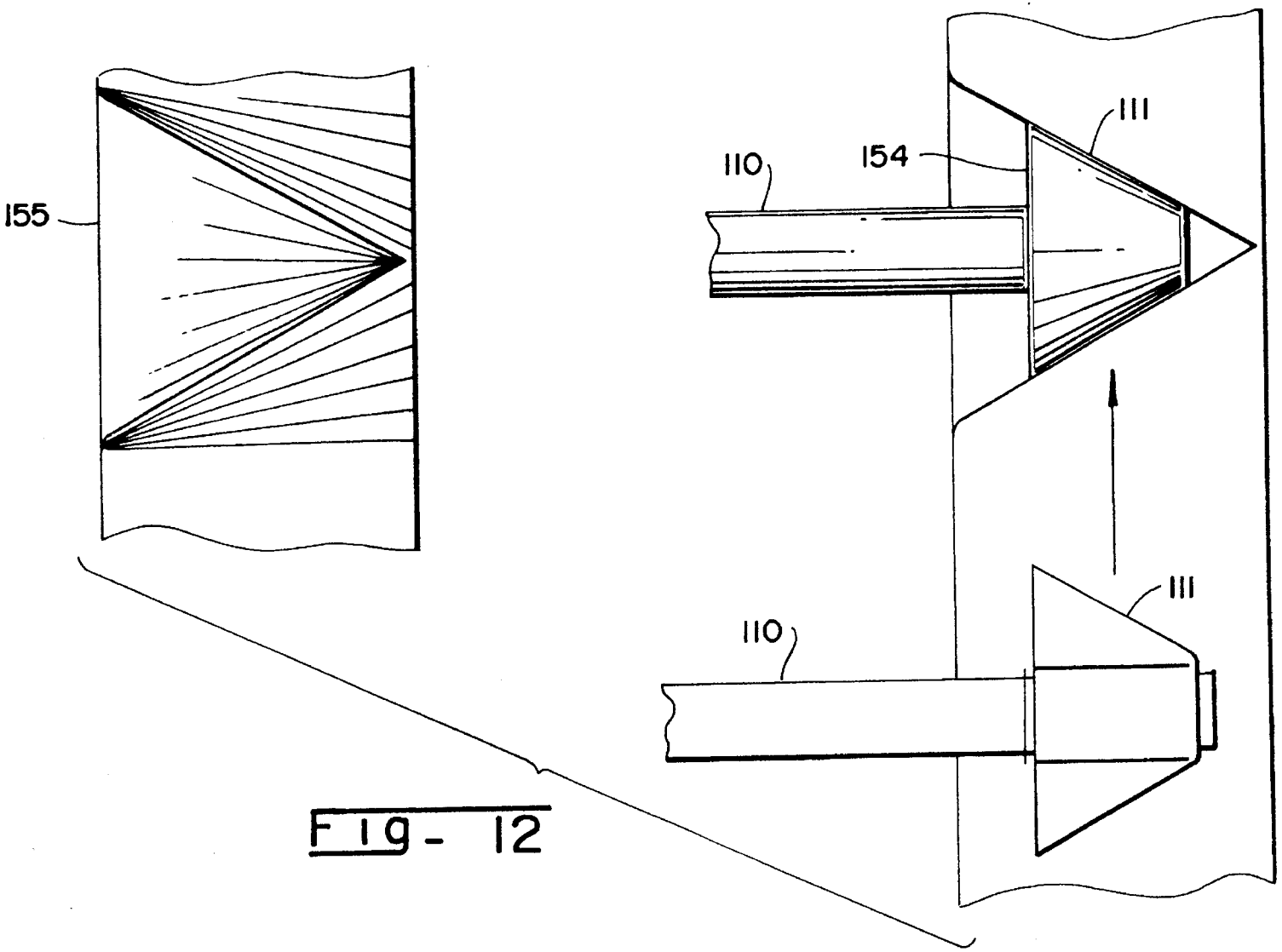
FIG. 12 is a schematic illustration of the conical wheel of the chemical processing trays and wheel tracks illustrating the wheel rolling down to the next level with the triangular stopper is removed.

The mobility of chemical processing trays 11, 12, and 13, in addition to providing a system by which prints may be developed inside corrugated sink housing 10, advantageously allows chemical processing trays 11, 12 and 13 to be emptied and cleaned without being removed from corrugated sink housing 10. Each corrugated groove in the side wall of corrugated sink housing 10 does not terminate at end wall 17 but extends in a 180° semi-circular bend 156 to the corrugated groove below. As shown in FIGS. 10 and 12, triangular apertures 155 in each corrugated groove provides a path for conical wheels 111 to travel to the corrugated groove below. During print processing, the chemical processing trays are prevented from inadvertently moving to the corrugated groove below by triangular inserts 154 blocking triangular apertures 155. Conical inserts 154 are then advantageously removed after print processing has been completed when chemical processing trays 11, 12 and 13 should be cleaned.

Figure 11:
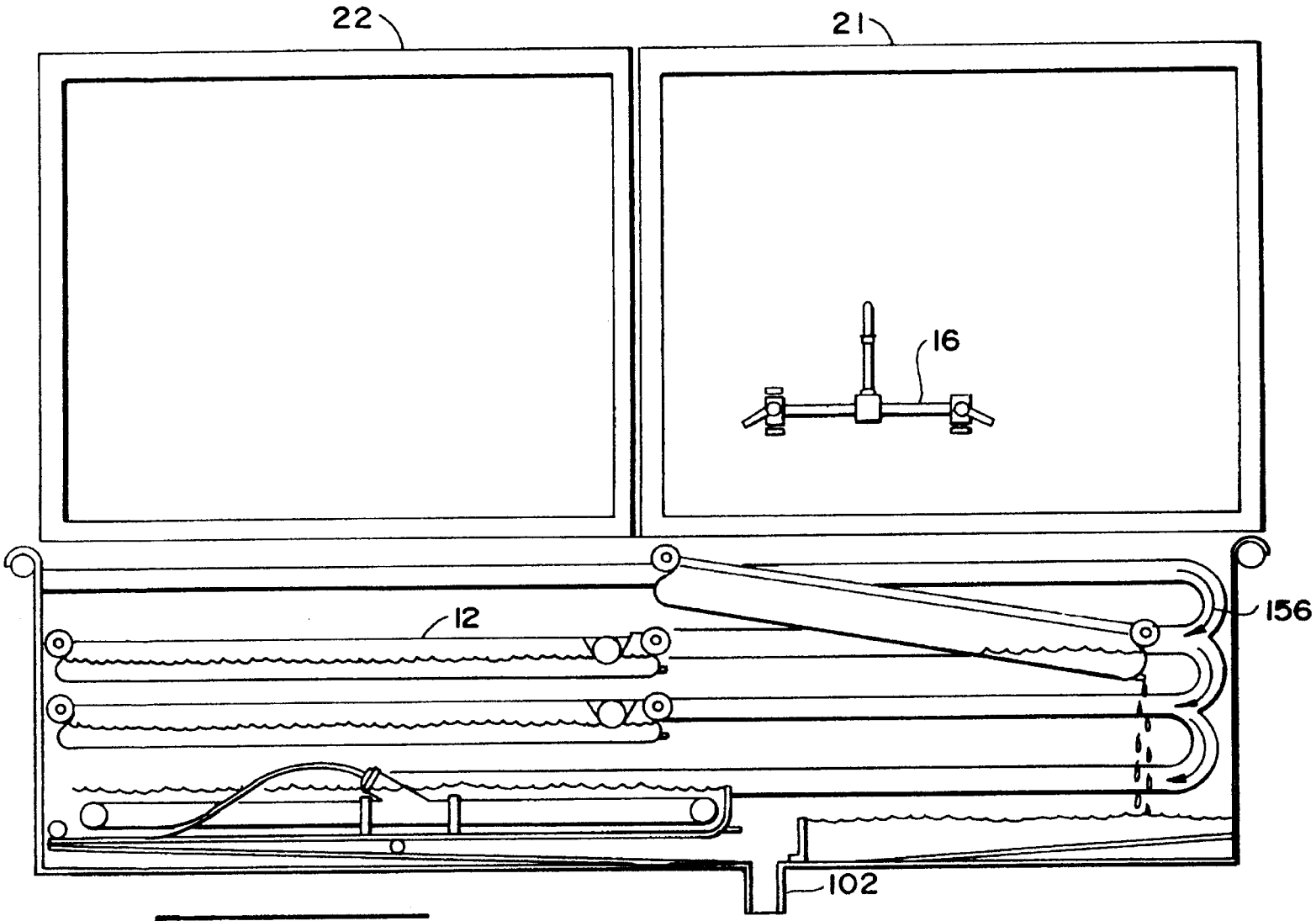
FIG. 11 is a partial cross-sectional front view of the photographic processing apparatus of FIG. 2 taken along line B—B illustrating a chemical processing tray angled downward to transfer chemicals from the tray into the basin area.

Referring now to FIG. 11, chemical processing tray 11 can be angled downward when triangular inserts 154 are removed and the end of the processing tray is rolled to the corrugated groove below. If desired, a greater angle may be achieved by rolling the end of chemical processing tray 11 down one or two more grooves further down. Advantageously, drain outlet 112 may be opened allowing the developer in chemical processing tray 11 to flow into basin area 15. This process can then be repeated for chemical processing trays 12 and 13. Angling chemical processing tray 11 downward to the furthest possible extent provides an optimal surface for removing excess water from the prints before placing them in drying racks 29.

Figure 21:
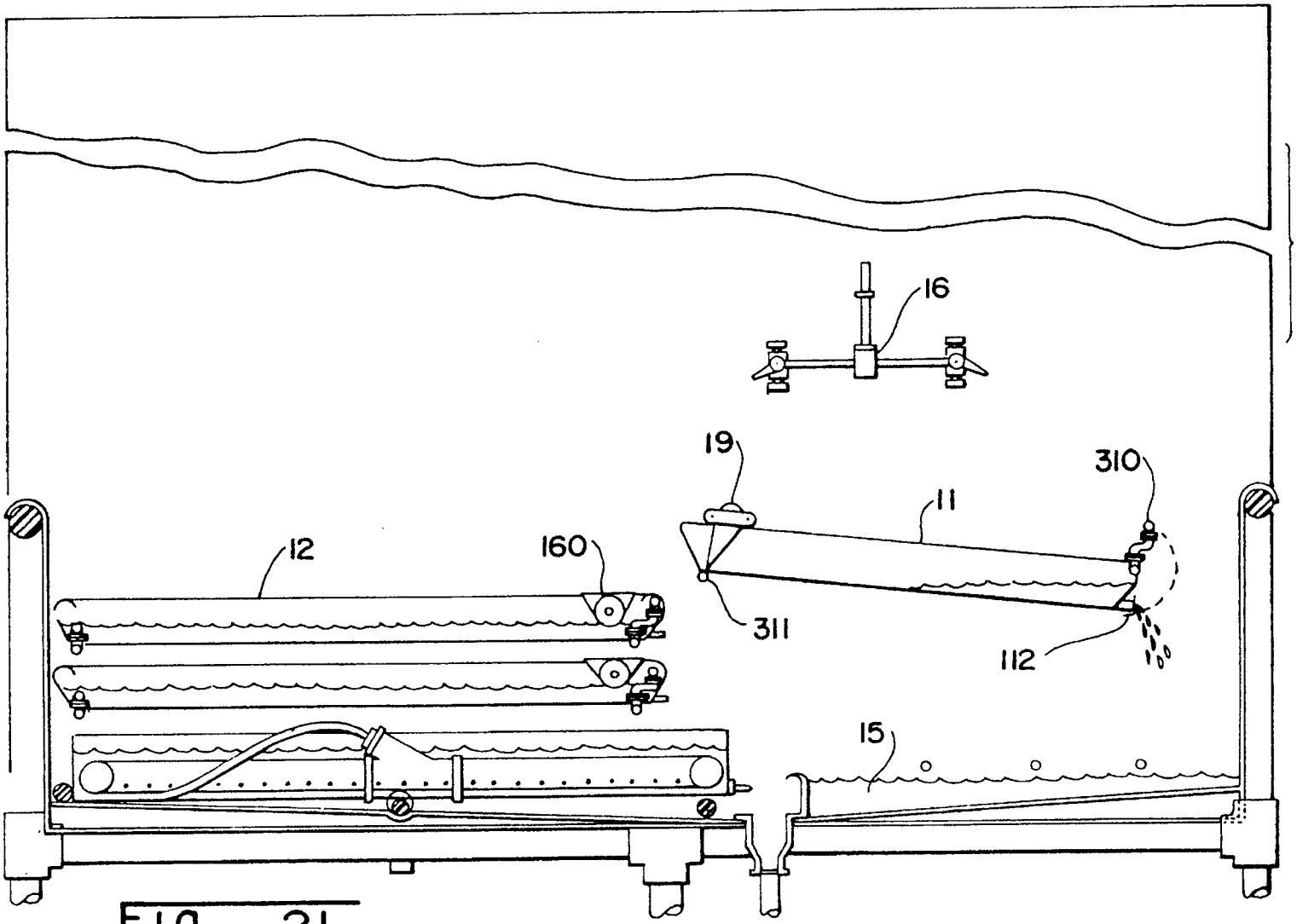
FIG. 21 is a partially sectional side view taken along line B—B of FIG. 2 illustrating an alternative implementation of the chemical processing trays.
Figure 22:
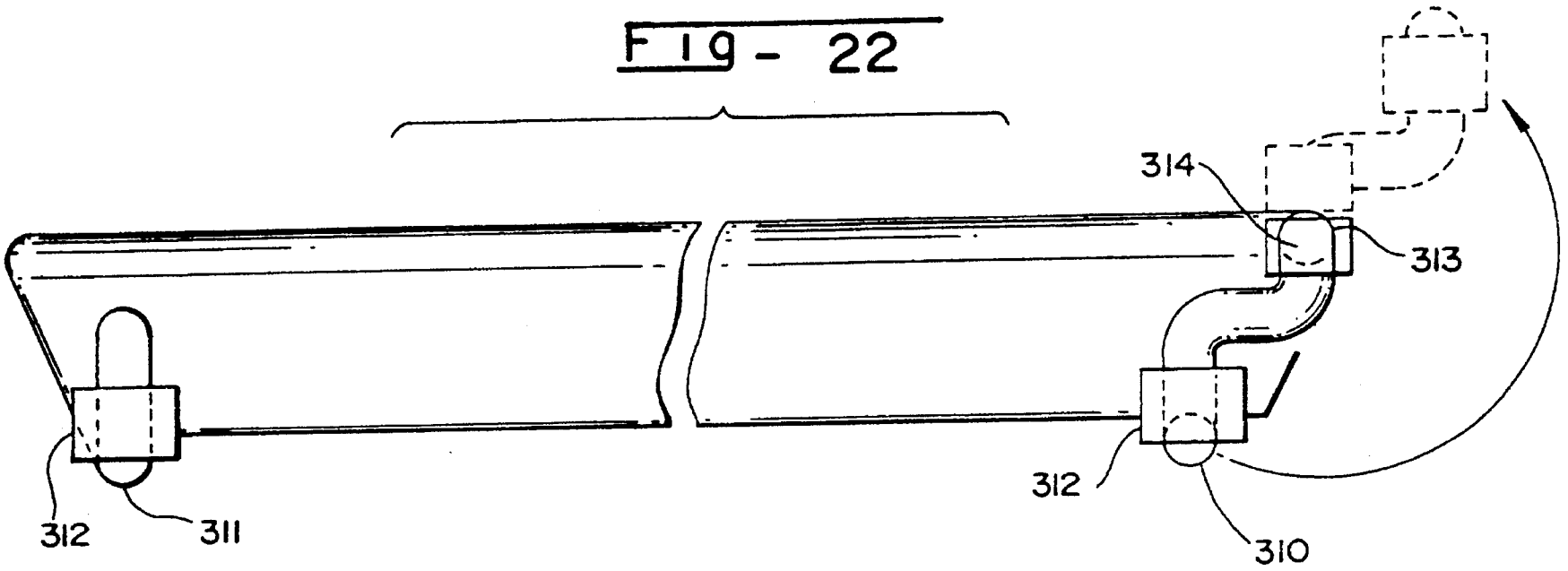
FIG. 22 is a cross-sectional side view illustrating the rotating axle of the chemical processing tray shown in FIG. 21.
Figure 23:
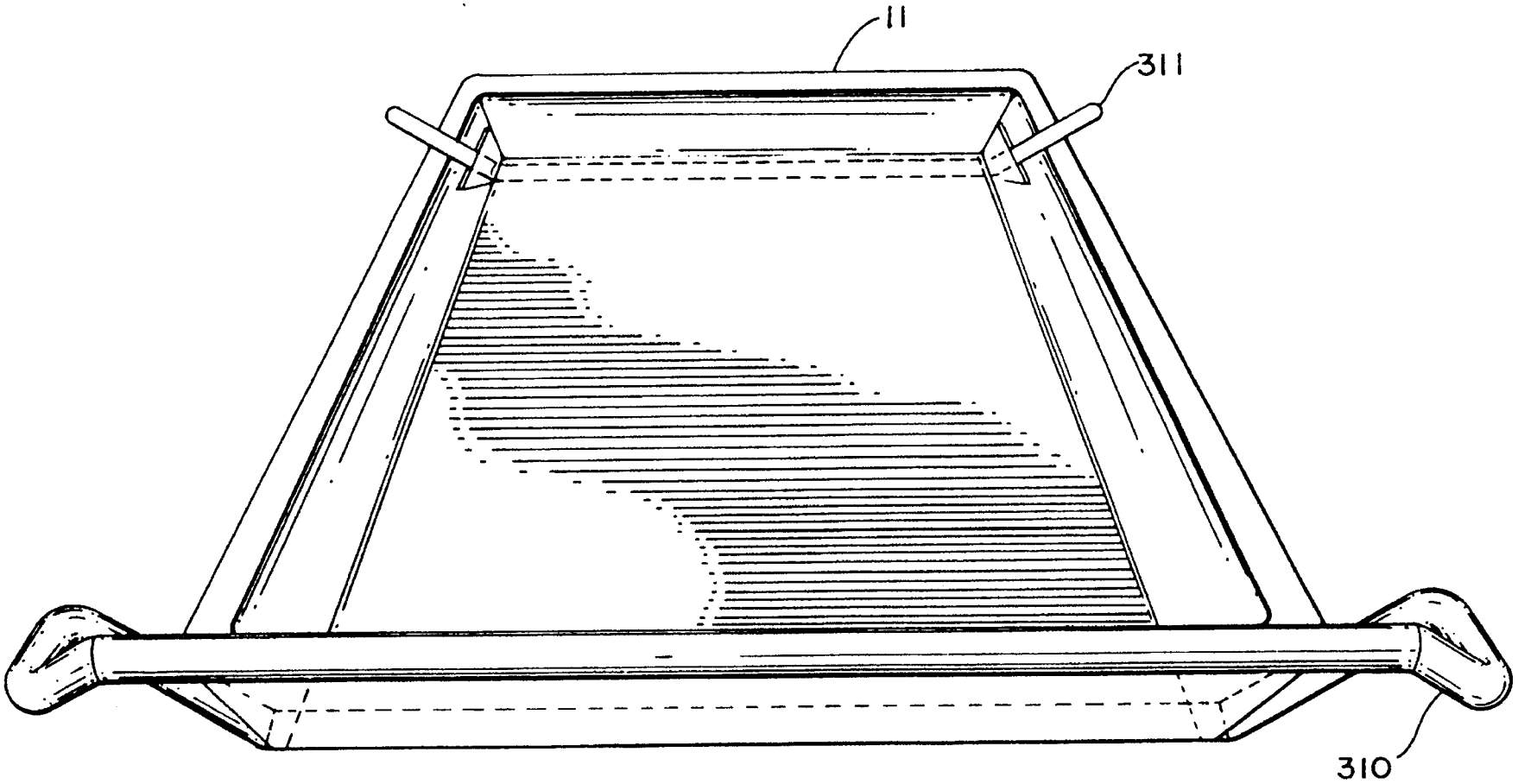
FIG. 23 is a perspective top view showing the rotating axle of the chemical processing tray shown in FIGS. 21–22.

Referring now to FIGS. 21 and 22, an alternative embodiment of the present invention is illustrated wherein the chemical processing trays may be angled downward using rotating axle 310. Referring now to FIGS. 22 and 23, stationary axle 311 is fixedly mounted to the bottom of chemical processing tray 11 whereas rotating axle 310 is pivotally mounted to the top. Round wheels 312 are rotatably affixed to stationary axle 311 and rotating axle 310. Rotating axle 310 is pivotally affixed to the top of chemical processing tray 11 at pivot 314. Wheel 312 remains generally stationary in the corrugated groove as chemical processing tray 11 is angled downward. Advantageously, the downward travel of chemical processing tray 11 is limited by cylinder 313 which engages the top of chemical processing tray 11 when rotating axle 310 is fully rotated.

In view of the foregoing description of my invention, it will be recognized by those skilled in the art that the disclosed embodiment may be changed and modified in various ways without departing from the scope of the invention. For example, the print sponge may be modified to include counter-rotating dual sponges that simultaneously sponge off the print being developed while transferring it to the next chemical processing tray or film development drums may be rolled using the corrugated grooves. Additionally, each tray could include thermostatically coupled heating elements to ensure isothermic processing chemicals or the axle configurations of the processing trays could be modified to allow a tray end to be tilted downward without moving to a lower groove.

What is claimed is:

1. A photographic processing apparatus comprising:

a generally rectangular housing having first and second generally parallel side walls, first and second end walls and a bottom side;

a plurality of chemical processing trays having first and second side walls, first and second end walls, and a bottom:

said chemical processing trays being slidably mounted to said generally parallel side walls of said generally rectangular housing for longitudinal movement parallel to said generally parallel side walls of said generally rectangular housing;

first and second covers pivotally mounted to one of said generally parallel side walls of said generally rectangular housing for enclosure thereof;

said first cover having a variable water supply disposed thereon; and said second cover having optically transparent top and bottom surfaces and a switchable fluorescent light source therebetween for illumination of said photographic processing apparatus.

2. A photographic processing apparatus comprising:

a generally rectangular housing having first and second generally parallel side walls, first and second end walls and a bottom side;

a plurality of chemical processing trays having first and second side walls, first and second end walls, and a bottom;

said chemical processing trays being slidably mounted to said generally parallel side walls of said generally rectangular housing for longitudinal movement parallel to said generally parallel side walls of said generally rectangular housing;

a print wash bath having generally parallel first and second side walls, first and second end walls and a bottom side;

said bottom side having a fulcrum projecting below the bottom surface thereof; and said fulcrum being frictionally coupled to the top surface of said bottom side of said generally rectangular housing for oscillation of said print wash bath upon said fulcrum.

3. The photographic processing apparatus of claim 2 wherein said print wash bath further comprises a tube operably coupled to a variable water supply and encircling the inner perimeter of said first and second end walls and said first and second side walls of said print wash bath;

said tube having a plurality of perforations disposed proximate said bottom side and opposite said walls of said print wash bath for transmission of water.

4. The photographic processing apparatus of claim 3 wherein said print wash bath further comprises a flexible solid disposed in said tube and having a density significantly different than water for displacing a volume of water from said tube to locally vary the weight of said perforated tube whereby said print wash bath oscillations are generated.

5. The photographic processing apparatus of claim 4 wherein said flexible solid comprises a plurality of flexibly interconnected spheres.

6. The photographic processing apparatus of claim 4 wherein said print wash bath further comprises:

a first counterweight disposed proximate said first end wall and a second counterweight disposed proximate said second end wall for counterbalancing oscillations of said print wash bath.

7. The photographic processing apparatus of claim 3 wherein said fulcrum is disposed between said first and second print wash bath end walls and extends between said first and second print wash bath side walls and the top surface of said bottom side of said generally rectangular housing further comprises an incline angled downward from said first end well to the center of said generally rectangular housing and having a medially disposed groove operably coupled to said fulcrum.

8. A photographic processing apparatus comprising:

a generally rectangular housing having first and second generally parallel side walls, first and second end walls and a bottom side;

said generally parallel side walls being horizontally corrugated and the corrugations on said first generally parallel side wall being inversely indented to the corrugations on said second generally parallel side wall;

a plurality of chemical processing trays having first and second side walls, first and second end walls, and a bottom;

said chemical processing trays being slidably mounted to said generally parallel side walls of said generally rectangular housing for longitudinal movement parallel to said generally parallel side walls of said generally rectangular housing; and said chemical processing trays have first and second removably affixed axles having first and second rotatably affixed wheels cooperatively interfit to grooves formed by said corrugations for rolling therein.

9. The photographic processing apparatus of claim 8 wherein said wheels are frustums and further comprising:

a plurality of arcuate grooves having an upper end and a lower end and extending between the grooves formed by said corrugations for continuous communication therebetween; and a plurality of conical inserts removably coupled to said upper end of said arcuate grooves for preventing traversal by said wheels thereof.

10. The photographic processing apparatus of claim 8 wherein said first axles are fixedly mounted to said chemical processing trays; and said chemical processing tray is pivotable about said second axle to displace the end of said chemical processing tray from a position above the groove to a position below the groove.

11. The photographic processing apparatus of claim 8 further comprising:

a tubular support structure having a plurality of interconnected tubes;

said interconnected tubes describing a first cube and a second cube disposed below said generally rectangular corrugated housing, said first and second cubes having a common interior sides, adjacent top sides and opposite exterior sides;

said interconnected tubes further describing a plurality of horizontal rectangles frictionally interfitting the grooves formed by said corrugations of said generally rectangular corrugated housing whereby said generally rectangular corrugated housing is supported;

horizontally corrugated sheets having a length and width substantially equivalent to the length and width of said exterior sides for interfitting therein and arcuate top and bottom edges for frictionally engaging said interconnecting tubes; and print drying screens having rounded edges for slidably engaging the grooves in said horizontally corrugated sheets.

12. A photographic processing apparatus comprising:

a generally rectangular housing having first and second generally parallel side walls, first and second end walls and a bottom side;

a plurality of chemical processing trays having first and second side walls, first and second end walls, and a bottom;

said chemical processing trays being slidably mounted to said generally parallel side walls of said generally rectangular housing for longitudinal movement parallel to said generally parallel side walls of said generally rectangular housing;

a print gripper having a generally planar first part compressively engaged to a generally planar second part, each part having a width at least equal to the width of the print under development, a handle end and a gripping end;

said gripping end of said first part having a lip protruding at an angle from the plane of thereof; and said gripping end of said second part having a rounded portion frictionally engaging said protruding lip of said first part for gripping the print therebetween.

13. A photographic processing apparatus comprising:

a generally rectangular housing having first and second generally parallel side walls, first and second end walls and a bottom side;

a plurality of chemical processing trays having first and second side walls, first and second end walls, and a bottom;

said chemical processing trays being slidably mounted to said generally parallel side walls of said generally rectangular housing for longitudinal movement parallel to said generally parallel side walls of said generally rectangular housing;

a cylindrical print sponge having first and second ends and a length substantially equal the width of said chemical processing tray;

said print sponge having mounting brackets at said first and second ends for removably affixing said print sponge to said first and second side walls of said chemical processing trays; and a sponge ringer having a semi-circular clamp slidably coupled to said print sponge and having a diameter substantially less than the diameter of said print sponge for compressing portions thereof.

14. A photographic processing apparatus comprising:

a generally rectangular housing having first and second generally parallel side walls, first and second end walls and a bottom side;

a plurality of chemical processing trays having first and second side walls, first and second end walls, a bottom, and inwardly angled wave guards on said end walls for containing wave disturbances in the chemicals contained therein; and said chemical processing trays being slidably mounted to said generally parallel side walls of said generally rectangular housing for longitudinal movement parallel to said generally parallel side walls of said generally rectangular housing.

15. A photographic processing apparatus comprising:

a generally rectangular housing having first and second generally parallel side walls, first and second end walls and a bottom side;.

a plurality of chemical processing trays having first and second side walls, first and second end walls, and a bottom;

said chemical processing trays being slidably mounted to said generally parallel side walls of said generally rectangular housing for longitudinal movement parallel to said generally parallel side walls of said generally rectangular housing;

a rolling print squeegee having a protruding triangular squeegee extending the width of said chemical processing trays and having first and second ends; and said first and second ends having a plurality of concave wheels cooperatively interfitting said side walls of said chemical processing trays for rolling traversal thereon without lateral skewing of said rolling print squeegee.

16. An oscillating photographic print bath comprising:

a tray having first and second side walls, first and second end walls, and a bottom;

said bottom having a fulcrum disposed between said first and second end walls and extending between said side walls;

a tube encircling the inner perimeter of said first and second side walls and said first and second end walls;

a flexible solid disposed in said tube and having a density significantly different than water for locally displacing a volume of water from said tube;

said tube having an inlet aperture disposed away from the interior of said bath for receiving water therethrough; and said tube having a plurality of outlet apertures disposed toward the interior of said bath for expelling water whereby said flexible solid is moved through said tube by flow of water through said tube and thereby oscillates said tray.

17. The oscillating photographic print bath of claim 16 further comprising a first counterweight disposed proximate said first end wall and a second counterweight disposed proximate said second end wall whereby oscillations of said tray are counterbalanced.

* * * * *